United States Patent [19]

Callahan

[11] Patent Number: 4,947,302

[45] **Date of Patent: * Aug. 7, 1990**

[54] IMPROVEMENTS TO CONTROL SYSTEMS FOR VARIABLE PARAMETER LIGHTING FIXTURES

[76] Inventor: Michael Callahan, 40 W. 94th St., New York, N.Y. 10025

[ * ] Notice: The portion of the term of this patent subsequent to Jul. 2, 2002 has been disclaimed.

[21] Appl. No.: 423,363

[22] Filed: Oct. 18, 1989

Related U.S. Application Data

[63] Continuation of Ser. No. 250,316, Sep. 28, 1988, Pat. No. 4,894,760, which is a continuation-in-part of Ser. No. 66,790, Jun. 25, 1987, Pat. No. 4,797,795, which is a continuation of Ser. No. 750,873, Jul. 1, 1985, Pat. No. 4,697,227, which is a continuation-in-part of Ser. No. 443,127, Nov. 19, 1982, Pat. No. 4,527,198.

[51] Int. Cl.[5] ..... F21M 7/00

[52] U.S. Cl. ..... 362/233; 362/268; 362/277; 362/319; 315/312

[58] Field of Search ..... 362/233, 239, 250, 268, 362/277, 280, 281, 282, 283, 284, 319, 321, 322, 323, 324; 315/312, 313

[56] References Cited

U.S. PATENT DOCUMENTS

| | | | |
|---|---|---|---|
| 3,845,351 | 10/1974 | Ballmoos et al. | 362/253 X |
| 3,898,643 | 8/1975 | Ettlinger | 362/85 X |
| 4,392,187 | 7/1983 | Bornhorst | 362/286 X |
| 4,527,198 | 7/1985 | Callahan | 362/285 X |
| 4,697,227 | 9/1987 | Callahan | 362/233 |
| 4,797,795 | 1/1989 | Callahan | 362/233 |

*Primary Examiner*—Stephen F. Husar
*Attorney, Agent, or Firm*—Kenyon & Kenyon

[57] ABSTRACT

Methods and apparatus are disclosed for improving the performance of variable parameter lighting systems. Such systems that employ relatively modest speed serial communications between the controller and the fixtures or devices, yet which must accommodate the relatively large amount of desired adjustment data that must be transmitted over the data link for each lighting effect.

20 Claims, 20 Drawing Sheets

486
403
420
405
REGISTER
OUT
L
IN
498L
576B
576
562L
562D
311
R
ADD
DEC
LOCAL MEMORY
498
ADD
DATA
575
497
560L
562
560A
R
DECODER
560R
560D
568
561A
T
ENCODER
561T
561E

IMPROVEMENTS TO CONTROL SYSTEMS FOR VARIABLE PARAMETER LIGHTING FIXTURES

This is a continuation of application Ser. No. 250,316 filed Sept. 28, 1988, now U.S. Pat. No. 4,894,760.

This application relates to entertainment lighting and, more specifically, to improvements to control systems for variable parameter lighting fixtures and devices.

It represents a continuation-in-part of application Ser. No. 07/66,790, entitled "Improved Control System for Variable Parameter Lighting Fixtures", filed June 25, 1987 now U.S. Pat. No. 4,797,795; a continuation of application Ser. No. 750,873, entitled "Control System for Variable Parameter Fixtures" filed July 1, 1985, now U.S. Pat. No. 4,697,227; a continuation-in-part of application Ser. No. 443,127, entitled "Improved Followspot Parameter Feedback", filed Nov. 19, 1982, now U.S. Pat. No. 4,527,198.

BACKGROUND OF THE INVENTION

Performance lighting systems have long employed large numbers of fixtures each selected and preadjusted to produce a beam of a particular size, shape, and color aimed at a fixed location on the stage. The only beam parameter variable during the performance is intensity, and the character of the lighting effect onstage is adjusted solely by changing the relative intensities of the variety of fixtures provided.

"Memory boards" allowing a user to store and subsequently recall "presets", each of which represents a digitally-coded record of the desired intensity for each of a plurality of discretely-controllable fixtures or groups of fixtures in a lighting effect have been known for decades, and the design of the modern, software-based, CRT-oriented memory board as disclosed in U.S. Pat. No. 3,898,643 has evolved to the point that such units are capable of—and lighting designers have come to demand—very complex effects. Further, lighting designers can choose from among various types and models of memory board differing in the manner in which they store cues (for example "tracking" versus "preset" boards) and in their operating protocols—and may have strong preferences for particular types and models as more familiar and/or more appropriate for a given production.

Despite the complexity of these dimming effects, lighting systems employing only fixtures controlling only intensity have the disadvantage of the need for many more fixtures than are used at any one time—or would be required were the fixtures capable of varying other beam parameters during the performance. There is the direct cost to buy or rent the large number of fixtures required plus their associated supporting structure, dimming equipment, and interconnecting cables as well as the time and labor required to install, adjust, and service this amount of equipment.

The electronic storage and recall of stored intensity values using "memory boards" has thus had no positive effect on the size of lighting systems, and indeed, by removing the practical limits on the number of control channels and presets which had been imposed by manual presetting consoles, the adoption of such electronic memory boards has lead to a substantial increase in the size of the lighting systems that employ them.

It has long been apparent that were fixtures able to change beam parameters in addition to intensity (like color, beam size, or even azimuth and elevation), either as the result of integral remotely actuatable mechanisms and/or devices (like color changers) which may be retrofitted to conventional fixtures, then lighting effects could be varied by actually changing the fixtures' beams rather than the dimming between otherwise identical fixtures with different fixed adjustments. Each such "multi-variable" fixture could, over the course of the performance, duplicate the results it currently requires many fixtures to achieve—as well as adding dynamic changes in the beam to the lighting effects possible —requiring fewer fixtures to produce a given lighting design with consequent savings.

The viability of employing fixtures with remotely adjustable beam size, color, shape and/or angle as a method of reducing system size depends upon a suitable control system, first disclosed in U.S. Pat. #3,845,351, capable of storing desired parameter values for each of the controlled parameters in each of the desired lighting effects and of automatically conforming the fixture's beam varying mechanisms to those values.

Similar systems were subsequently disclosed in U.S. Pat. #1,434,052 and U.S. Pat. #4,392,187, and today, the rental of such systems to concert, television, and theatrical productions is a multi-million dollar industry.

There have, however, been unexpected difficulties with developing a truly efficient embodiment of such a control system.

One class of such difficulties relate to the communications requirements between the centralized portion of the system and the variable parameter fixtures and devices controlled. Because a variable parameter fixture may provide for altering as many as eight different parameters of its beam, requiring the input of desired values for each, the total amount of data that must be transmitted over a serial data link between the centralized portion of a variable parameter control system and its fixtures or devices may total vastly more than that required in a conventional system controlling only intensity. One undesirable effect of this higher throughput has been very visible in at least one widely-used prior art automated lighting system. When the next "cue" in a sequence is executed, the changes in the beam parameters of the fixtures do not occur simultaneously, but "ripple" through the system, reflecting the time required to transmit new parameter values to each of the fixtures in the system.

Further, most conventional intensity control systems centralize the dimmers actually varying the fixtures' intensity in a limited number of racks or enclosures, limiting the number of nodes and therefore of decoders and connections on the serial data link. By contrast, variable parameter fixtures and devices mount the means varying each parameter on or in the fixture itself, requiring the distribution of multiplexed data to a very high number of nodes (and therefore decoders and connectors) distributed throughout the performance area, frequently in a far more EMI- and RFI-hostile environment than that encountered by a dimmer rack.

The use of automated lighting equipment therefore requires a data link that offers economy (given the number of decoders and interconnections required); greater reliability (given the more hostile environment); and far higher data rates (given the greater throughput required) than prior data links for intensity control.

Further, while prior disclosures of variable parameter systems were based on the assumption that such fixtures would be used on an exclusive basis, it has instead been the case that the number of variable parameter fixtures used per system may vary widely and that, contrary to expectations, variable parameter fixtures and devices of several different types may be employed in the same system, together with large numbers of conventional fixtures. These "read world" conditions further complicate the data transmission problem. To standardize on a data transmission scheme adapted for the demands of the largest possible number of the most sophisticated fixtures imposes a considerable penalty on system cost and complexity when used with smaller numbers of such fixtures and/or with fixtures and devices with more limited data requirements. Conversely, a data transmission scheme of more modest capability may be adequate to the needs of less demanding fixtures, but its decoders may be incapable of operation in a higher-performance system.

It is an object of the present invention to disclose techniques by which the communications workload on the data link between the centralized portion of a variable parameter control system and the fixtures and devices it controls may be reduced.

SUMMARY OF THE INVENTION

The improved variable parameter control system of the present invention minimizes data transmission requirements on the serial ink during a cue by means of a technique first disclosed in prior related application Ser. No. 443,127, now U.S. Pat. No. 4,527,198: by sending the desired parameter values for a cue to local electronics associated with the fixtures and/or devices prior to the execution of that cue, where they are maintained; and by employing a separate "Go" command to trigger actual cue execution. As a result, all of the fixtures and devices execute their parameter changes simultaneously, regardless of the number of fixtures or devices or of the data rate of the data link employed. Indeed, because cues no longer reflect the time required for transmission of new parameter values, a data link of modest capacity can be used.

Prior related applications disclose the many important additional advantages that accrue from multiple cue storage at the local electronics; but the mere transmission and maintenance of the next cue's parameter values suffice to achieve the above-described improvement in system performance.

Early automated lighting systems had also not provided for control over the rate of change between two successive values for beam parameters other than intensity. When added, this capability was typically provided by the same technique used in many intensity control systems: the time-divided calculation by the centralized portion of the system of the intermediate value of each fixture's parameter value and the transmission of that intermediate value to each fixture at each one of a regular series of intervals during the total period allotted for the transition between the two cues.

This approach has the disadvantage in automated lighting systems of imposing, due to the number discrete values that must be calculated, a very high computational workload on the centralized portion of the system, as well as the very high data rates required for the real-time transmission of the resulting values to the fixtures on the data link.

The improved variable parameter control system of the present invention obviates both of these demands on the system by transmitting the duration desired for the change in parameter value to the local electronics associated with the fixtures, which, upon receipt of the "Go" command, are responsible for metering out the parameter value change to equal the desired duration as described in prior related applications.

A third aspect of the invention relates to the integration of desired intensity values produced by other controllers into the serial data stream of, and/or the interface of conventional dimmers to, the output of a variable parameter control system. Prior art variable parameter control systems employing serial data distribution employ a common data word or packet for each unique fixture address with the desired value for each adjustable parameter including intensity. Such a format is incompatible with that used by most conventional consoles and dimmers controlling intensity.

As described in prior related U.S. Pat. No. 4,797,795, previous disclosures of automated lighting systems also failed to recognize the need to employ automated fixtures in the company of large numbers of conventional fixtures adjusted only in intensity - or the desirability of employing conventional lighting control consoles to do so. The use of a separate, conventional controller for intensity in combination with a specialized automated lighting controller was first disclosed in prior related application Ser. No. 443,127, now U.S. Pat. No. 4,527,198. The improved automated lighting control system of the present invention further addresses this need and this object by employing separate data words containing the desired intensity values of a plurality of fixtures, preferably in the general format used by conventional controllers. As a result, conventional dimmers can be driven by the serial output of the variable parameter control system with little modification, and the serial output of a conventional controller can be used to adjust the intensity of variable parameter systems by doing little more than interleaving its output packets with those of the variable parameter system (for parameters other than intensity) in a common serial data stream. Such an arrangement also readily permits the use of separate addresses for intensity control and for control of other parameters, as well as the use of a common addressing scheme for the intensity control of both variable parameter and conventional fixtures.

Other features, advantages, and benefits of the disclosed improvements to variable parameter control system will become apparent from the description.

DETAILED DESCRIPTION OF THE INVENTION

Figure 1:
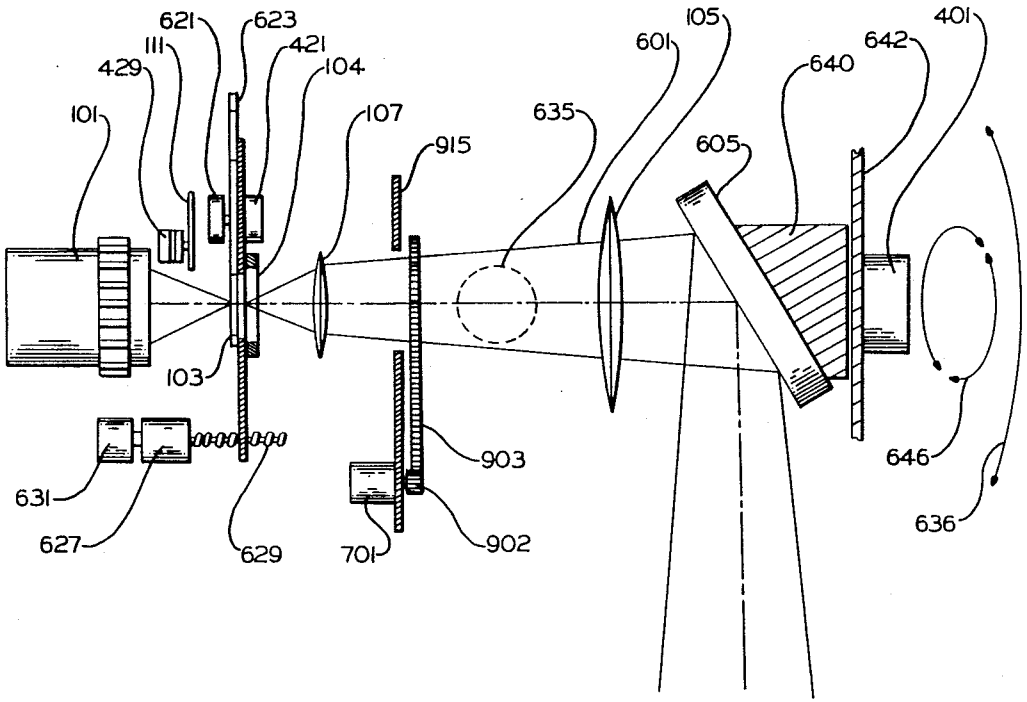
FIG. 1 is a section of one embodiment of the improved color mixing fixture of the present invention, equal to FIG. 1 of prior related application Ser. No. 750,873.
Figure 2:
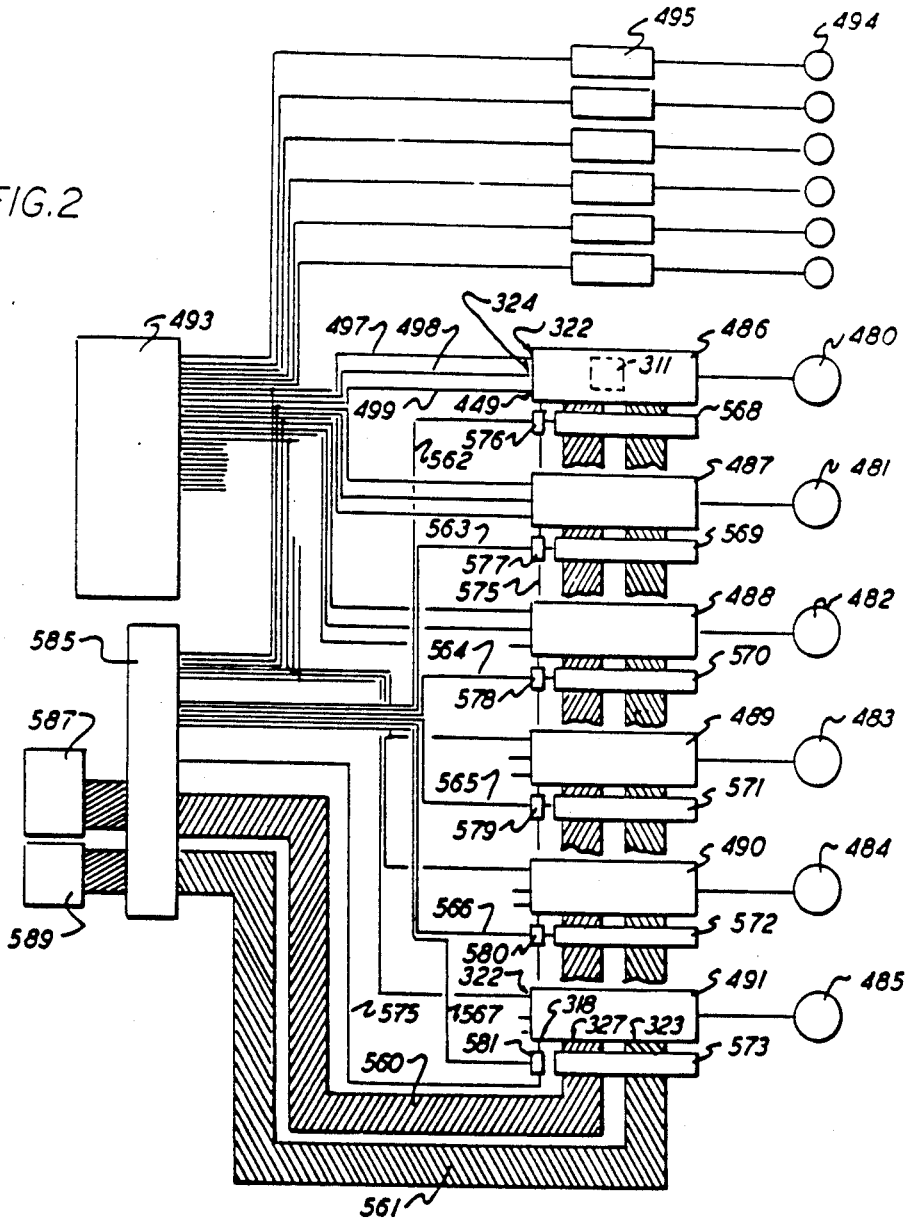
FIG. 2 is a block diagram of a control system which may be employed for the control of the disclosed color mixing fixture, equal to FIG. 2 of the same application.

Refer now to FIG. 1, reproduced from the prior related application Ser. No. 750,873, now U.S. Pat. No. 4,697,227, which, with prior related application Ser No. 443,127, now U.S. Pat. No. 4,527,198 and with U.S. Pat No. 4,527,198, are included in their entirety by reference.

FIG. 1 represents a section through one embodiment of a variable parameter lighting fixture suitable for use with the improved control system of the present invention A light source and its associated light collecting reflector 101 are combined with a fixed focal length optical system comprising lenses 107 and 105 imaging a circular aperture 103. Other types of optical elements and/or system may also be employed.

Various beam modifying elements including an iris 104 and a motorized gobo wheel 623 are located at the aperture. Ultimately, a solid state filter having a matrix of individually-addressable variable attenuation, diffusion, or reflection elements (employing, for example, liquid crystal or light valve technology) may be used to vary both beam size and shape.

Beam intensity may be remotely adjusted by means of mechanical dowser 111 and its associated beam intensity actuator 429, although an electronic dimmer as disclosed in U.S. Pat No. 3,397,344 may also be employed Beam intensity may also be varied by means of a solid state variable-diffusion filter such as the Mirrus TM filter (as distributed by Artiflex, Newport Beach, Calif). While such filters do not directly vary beam intensity, they have been located at the beam exit point to diffuse the beam, with the byproduct of reducing beam candlepower—and the undesirable effect of increasing beam size and therefore coverage. By contrast, locating such a filter prior to the imaged aperture (in the present example, in the same plane as mechanical dowser 111), this undesirable effect can be reduced or eliminated A second such filter located forward of the aperture; the displacement of an optical element; or the displacement of the aperture assembly along the optical axis with actuator 627 may be employed to vary beam edge sharpness Beam azimuth and elevation may be adjusted by two-axis displacement of the fixture, as disclosed in U S Pat. Nos. 1,680,685 and 1,747,279, or of a beam-directing mirror as disclosed in U.S. Pat. No. 2,054,224 or any other known means. In the illustrated embodiment, beam angle is adjusted by reflection from mirror 605 which is mounted by bracket 640 to motor 402 which, in turn, is mounted to the forward end of fixture chassis 642. This allows the rotation 646 of the beam in a first plane perpendicular to the optical centerline. The fixture chassis 642, in turn, is supported at its center of gravity by a yoke and pivot driven by motor 635 which allows the rotation 636 of the fixture in a second plane parallel to the optical centerline but always perpendicular to the first plane of rotation for the beam.

The fixture of FIG. 1 is illustrated as employing the multi-filter color mixing system described in detail in the parent application Ser. No. 250,316, now U.S. Pat. No. 4,894,760, included in its entirety by reference.

Figure 3:
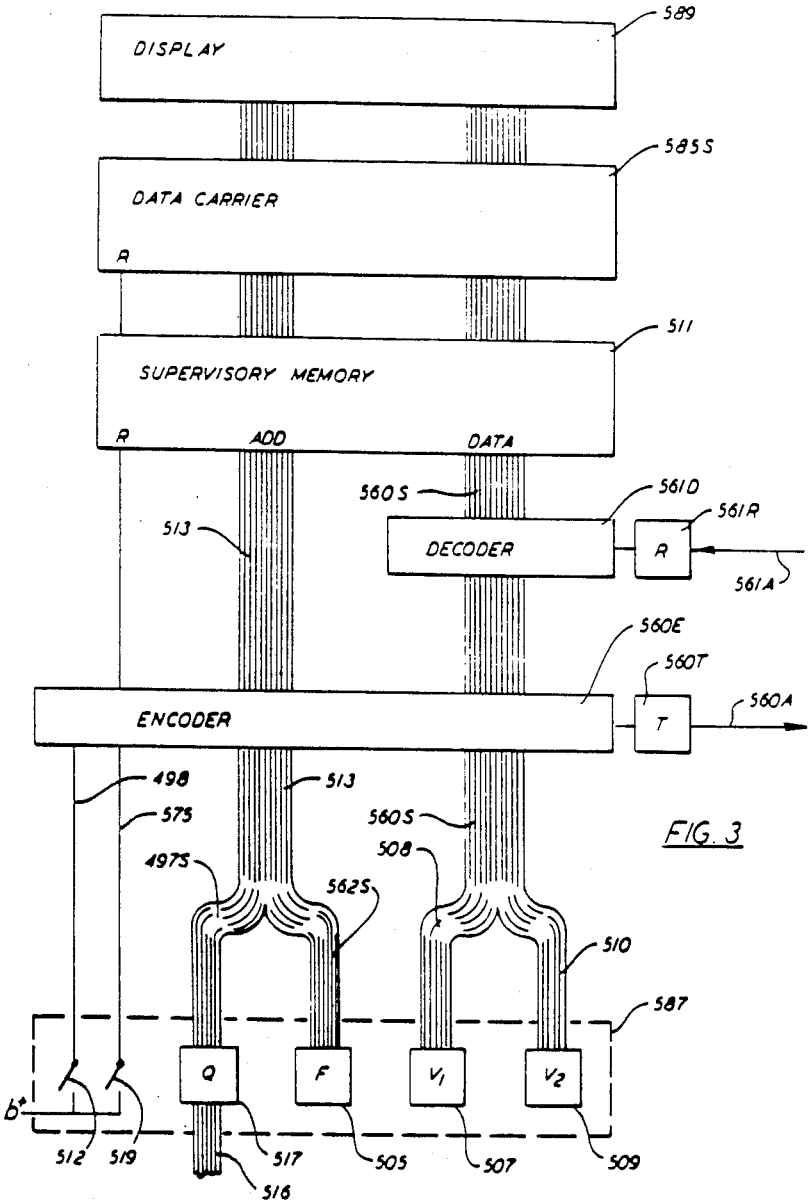
FIG. 3 is a detailed view of one embodiment of a supervisory control unit of FIG. 2, equal to FIG. 3 of the prior application.
Figure 4:
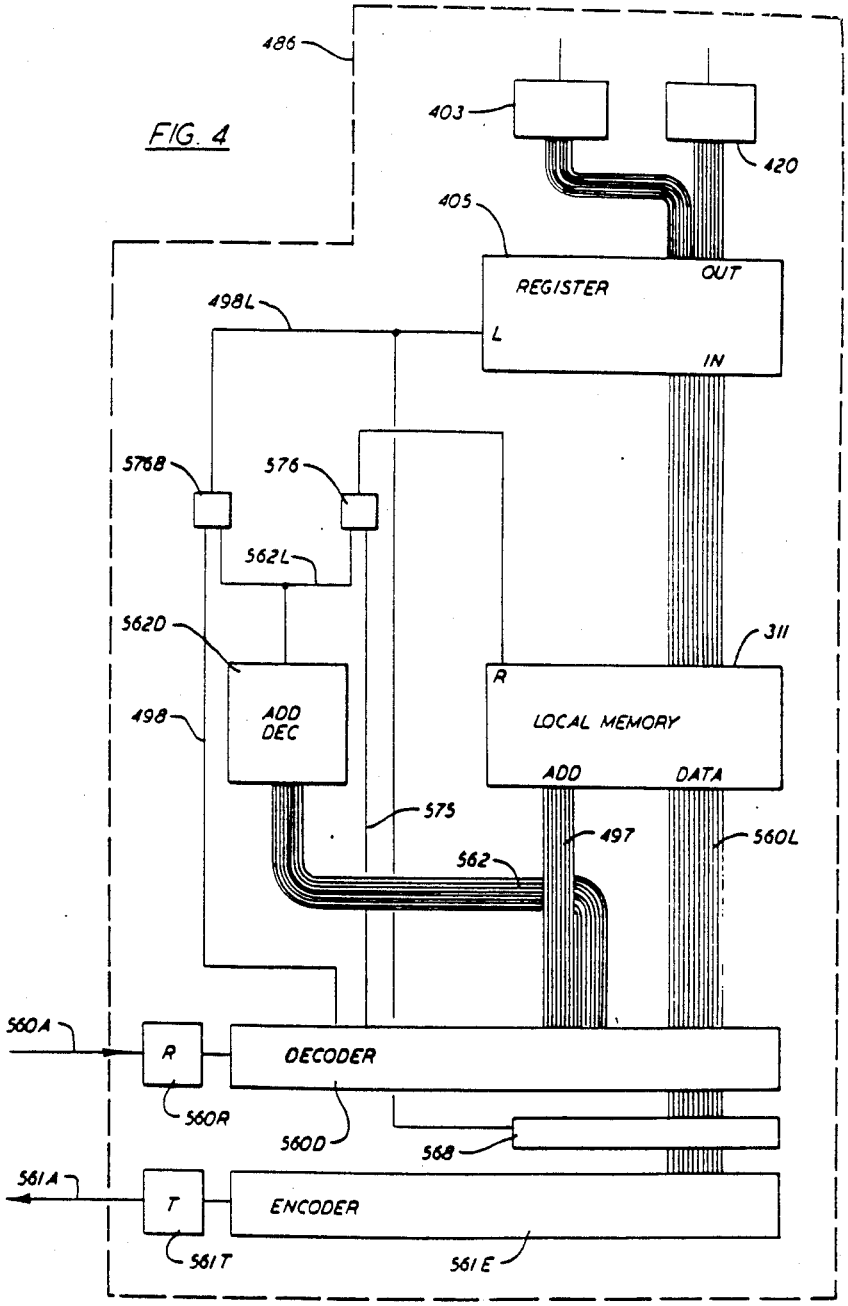
FIG. 4 is a detailed view of one embodiment of a local control system of FIG. 2, equal to FIG. 4 of the prior application.
Figure 5A:
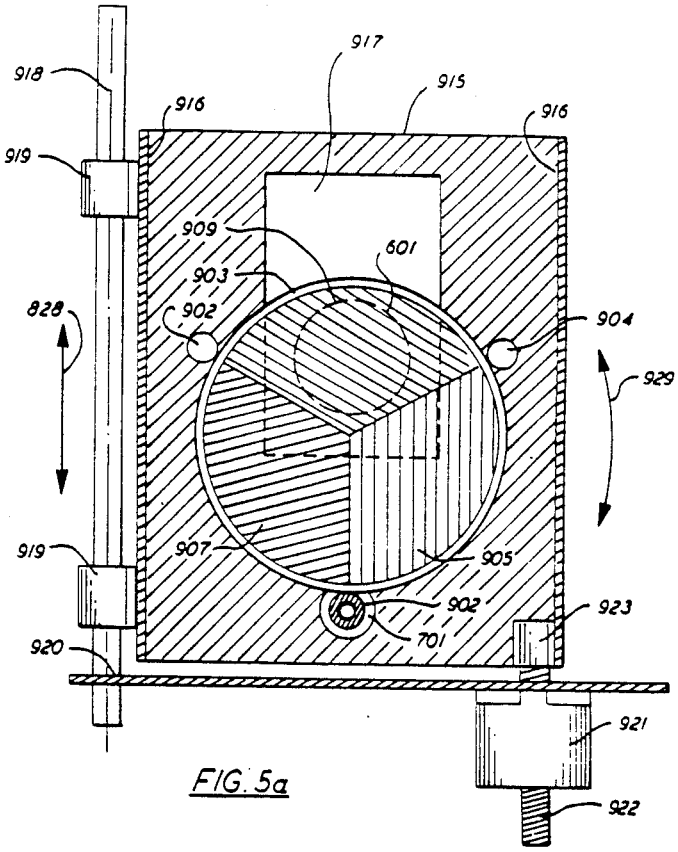
FIG. 5A is a detailed view of one embodiment of the filter array of the improved color mixing fixture of the present invention, equal to FIG. 5A of the prior application.
Figure 5B:
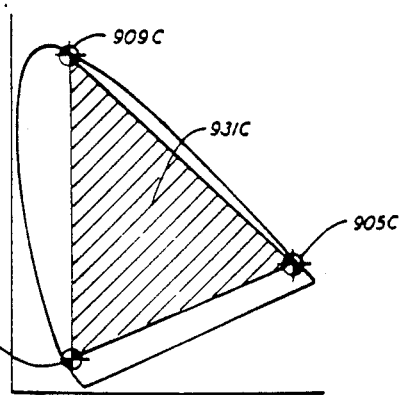
FIG. 5B is a CIE chromaticity diagram illustrating the coordinates of the filters employed in and possible color sensations produced by the filter array of FIG. 5A, equal to FIG. 5B of the prior application.
Figure 6A:
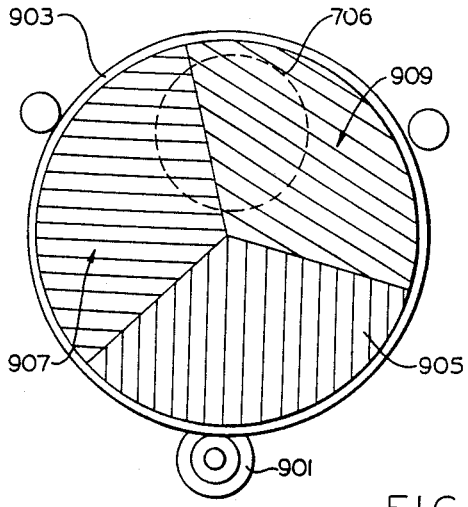
FIG. 6A illustrates the three segment filter array of FIG. 5A rotated such that the beam passes through two adjacent segments in unequal proportions.
Figure 6B:
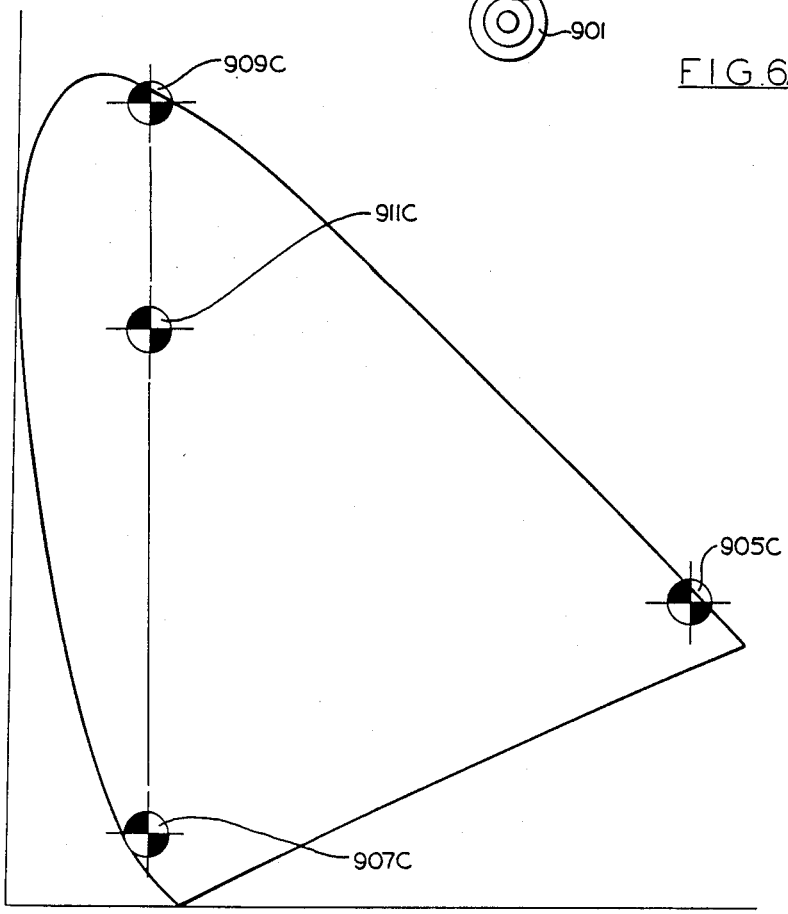
FIG. 6B is a CIE chromaticity diagram illustrating the coordinates of the filters employed in and color sensation produced by the filter array position of FIG. 6A.
Figure 7A:
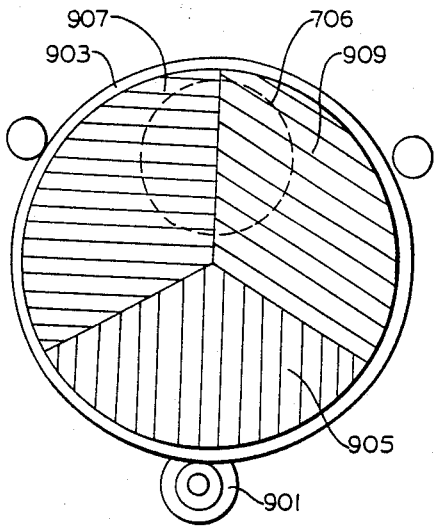
FIG. 7A illustrates the three segment filter array of FIG. 5A rotated such that the beam passes through two adjacent segments in equal proportions.
Figure 7B:
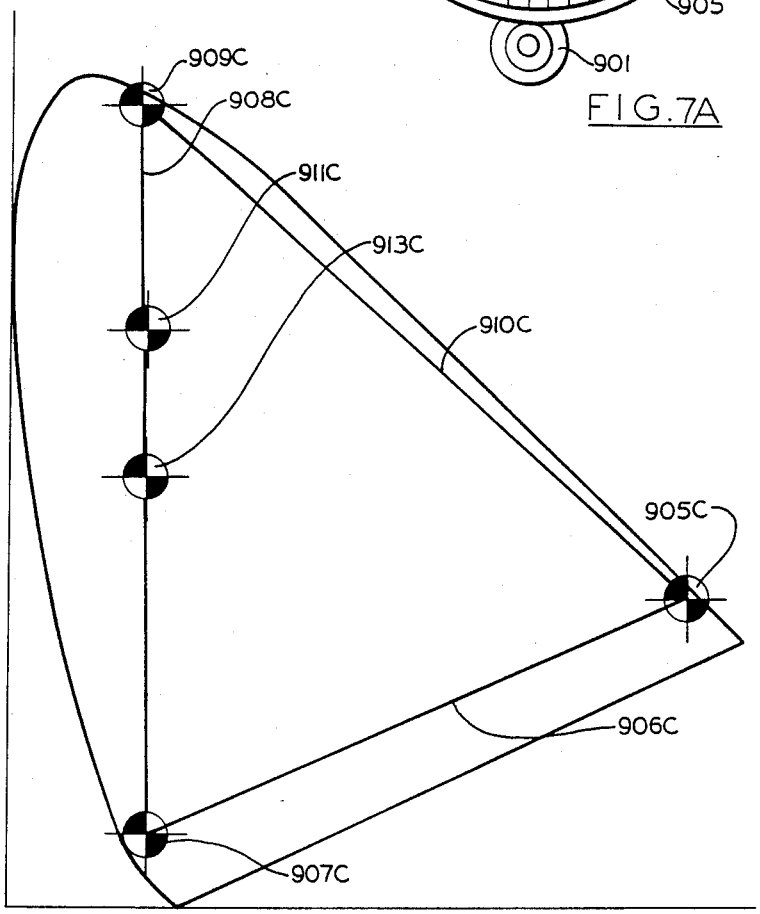
FIG. 7B is a CIE chromaticity diagram illustrating the coordinates of the filters employed in and color sensations produced by the filter array position of FIG. 7A and other filter array positions.
Figure 8A:
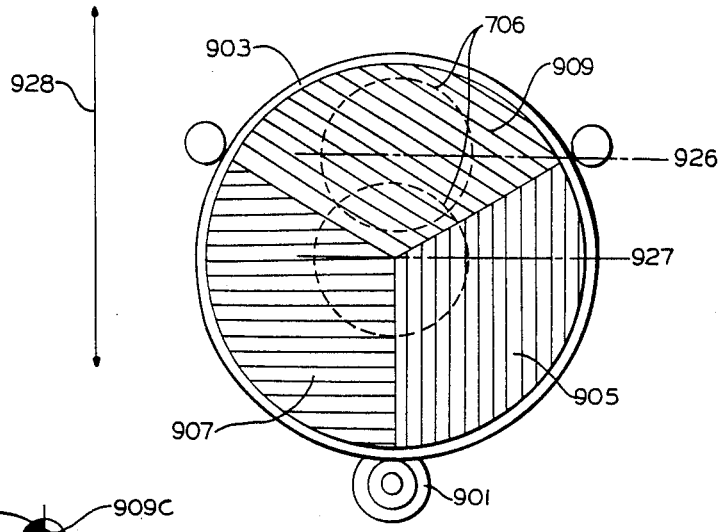
FIG. 8A illustrates the displacement of the three segment filter array of FIG. 5A such that the beam passes through all three filter segments in equal proportion.
Figure 8B:
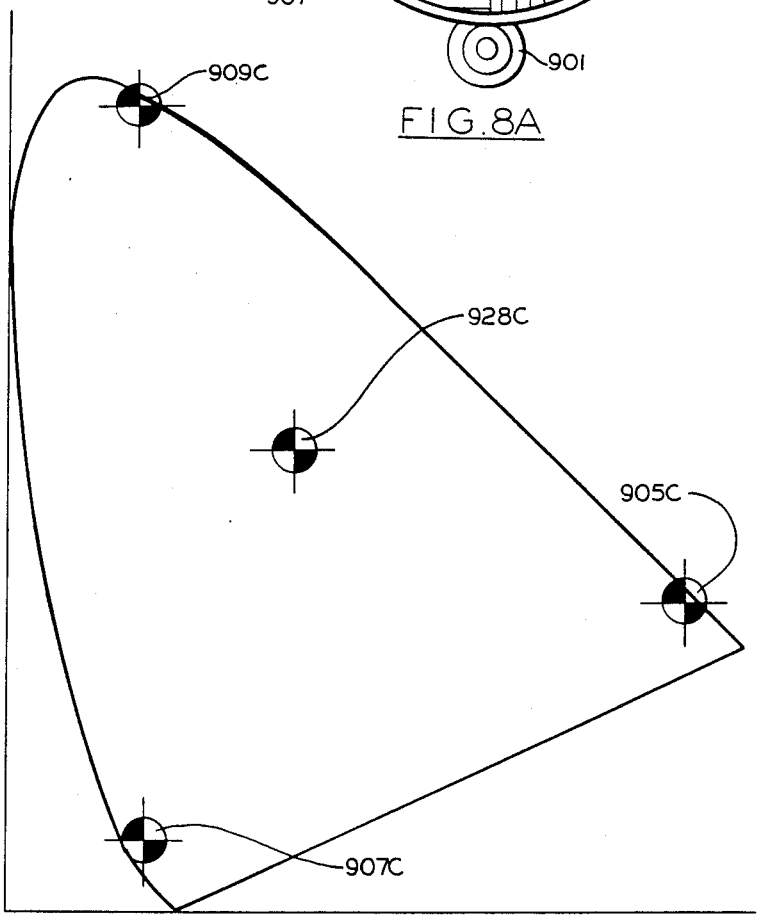
FIG. 8B is a CIE chromaticity diagram illustrating the coordinates of the filters employed in and color sensation produced by the filter array position of FIG. 8A.
Figure 9A:
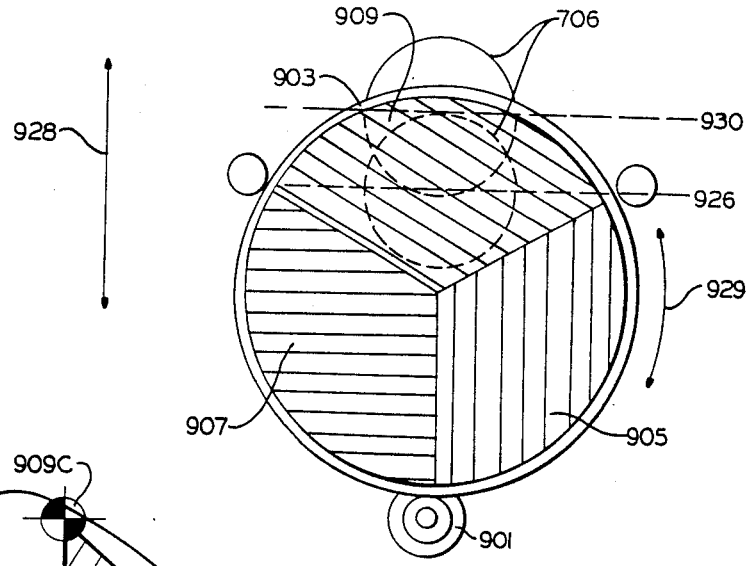
FIG. 9A illustrates the axes of rotation and displacement employed by the embodiment illustrated in FIG. 5A.
Figure 9B:
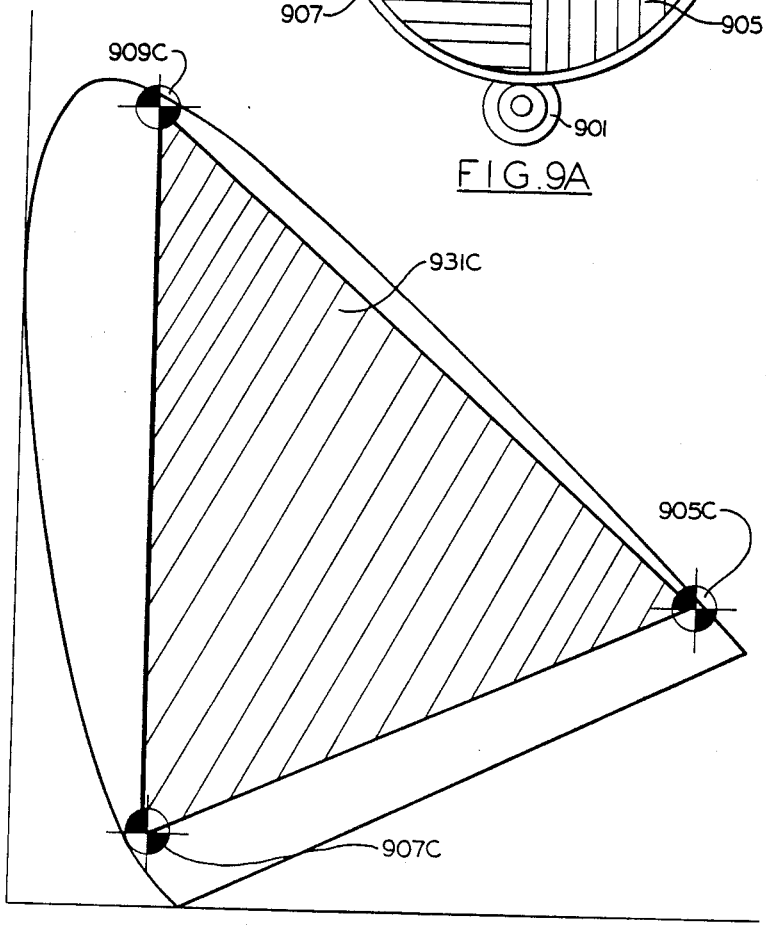
FIG. 9B is a CIE chromaticity diagram illustrating the range of possible color sensations produced by the combination of filter assembly rotation and displacement illustrated in FIG. 9A.
Figure 9C:
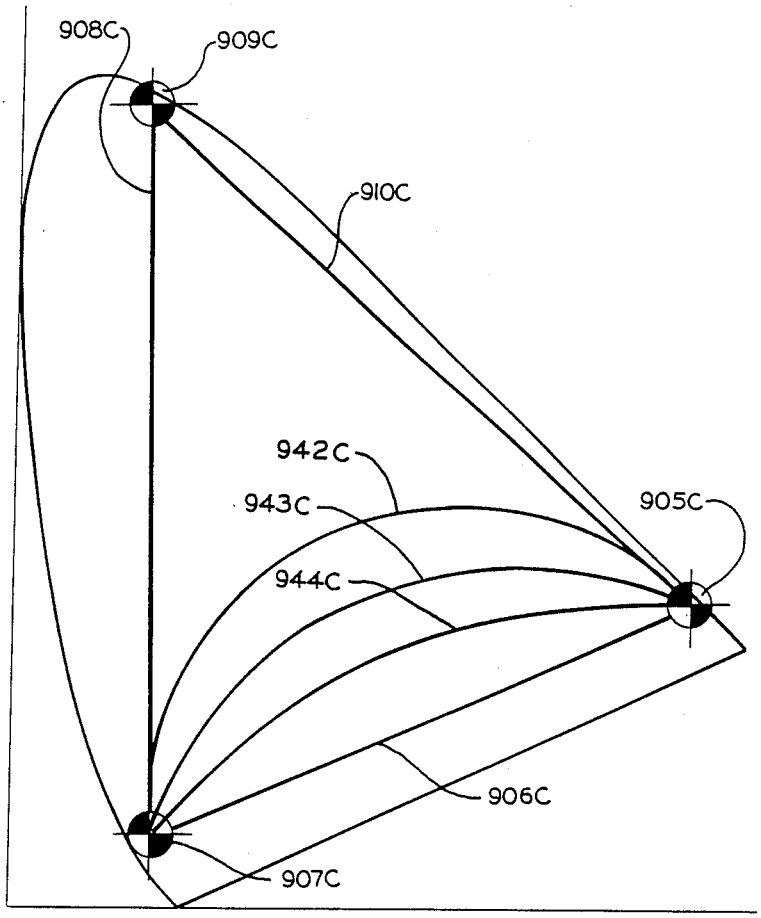
FIG. 9C is a CIE chromaticity diagram illustrating the range of possible transitions between color sensations that may be produced by different combinations of filter assembly rotation and displacement.
Figure 10A:
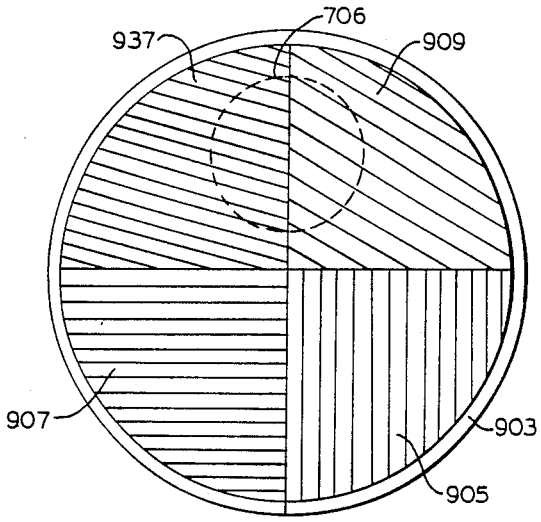
FIG. 10A illustrates a filter assembly having four filter elements.
Figure 10B:
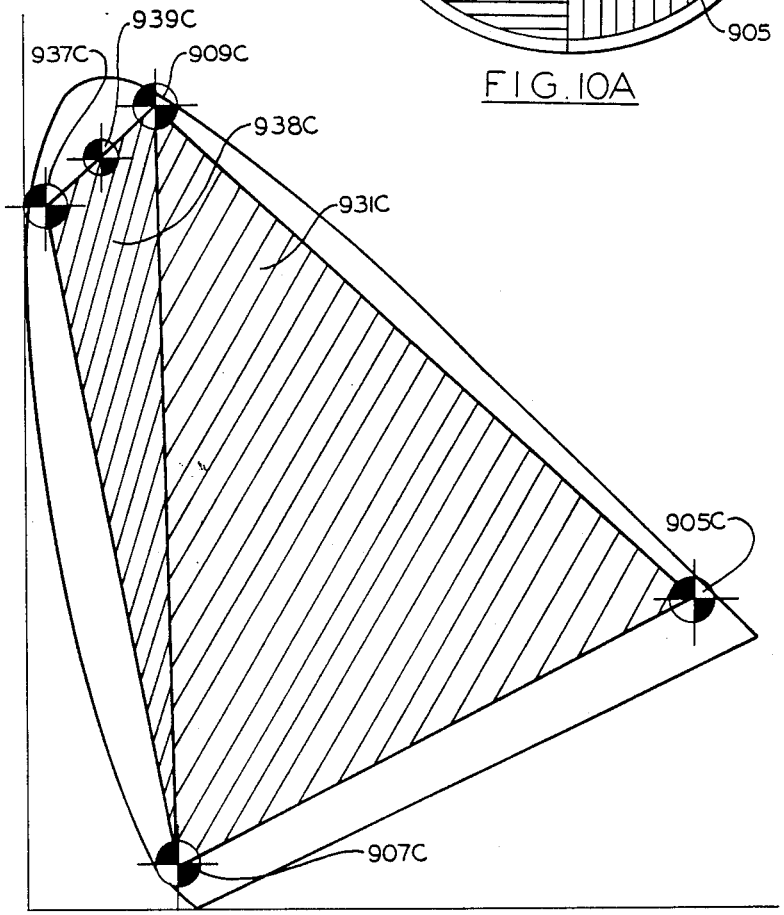
FIG. 10B is a CIE chromaticity diagram illustrating the improvement in the range of color sensations that may be produced by the color mixing fixture of the present invention with the addition of a fourth filter segment.

A variable parameter fixture such as illustrated in FIG. 1 may be coupled to a remote-control system, such as that illustrated and disclosed in the prior related applications, the Figures illustrating which are reproduced here. Actuators 701 and 921 of the color mixing fixture, as illustrated in FIG. 5A, may be coupled to motor drives 403 and 420 of a local control system as illustrated in FIG. 4. The parameter controls 507 and 509 of the supervisory control unit, as illustrated in FIG. 3 thus permit the direct adjustment of the hue and saturation of the light beam. The memory means 311 permits the user to store a desired color sensation for each lighting effect and to reproduce it at a later date.

In the case of a fixture providing not only for adjustment of beam color, but of other parameters such as beam pan, tilt, size, shape, edge-sharpness, and/or intensity; separate or a common memory means 311 may be used for the storage of desired adjustment values. In either case, this memory means 311 may take the form of a RAM or EEPROM memory card or otherwise readily removeable subassembly.

When prior automated lighting fixtures incorporating a local control system fail, requiring the replacement of the fixture with a spare, the removal of the failed fixture also removes all of the cues loaded in that fixture. Transferring those cues to the replacement fixture requires either a "null modem" connection between the failed and replacement fixtures, which is not only inconvenient under field conditions but presupposes that the failed fixture retains enough electronic functionality to participate in the transfer—or requires a download via the connection between the replacement fixture and the supervisory control system of a duplicate set of all of the parameter values for the fixture, which consumes a significant amount of time on the system data link (which is particularly undesirable under performance or rehearsal conditions).

By contrast, the use of a non-volatile data carrier for the local memory means 311 (or as a duplicate memory means with working memory provided in RAM) permits the rapid replacement of a failed fixture and the transfer of all desired parameter values to the replacement fixture by the simply expedient of unplugging the data cartridge from the failed unit and plugging it into the replacement.

While control systems suitable for use with the disclosed fixture have been the subject of many prior disclosures including the prior related applications, a control system with a more sophisticated operator interface and a variety of other novel features may also be employed.

Figure 11A:
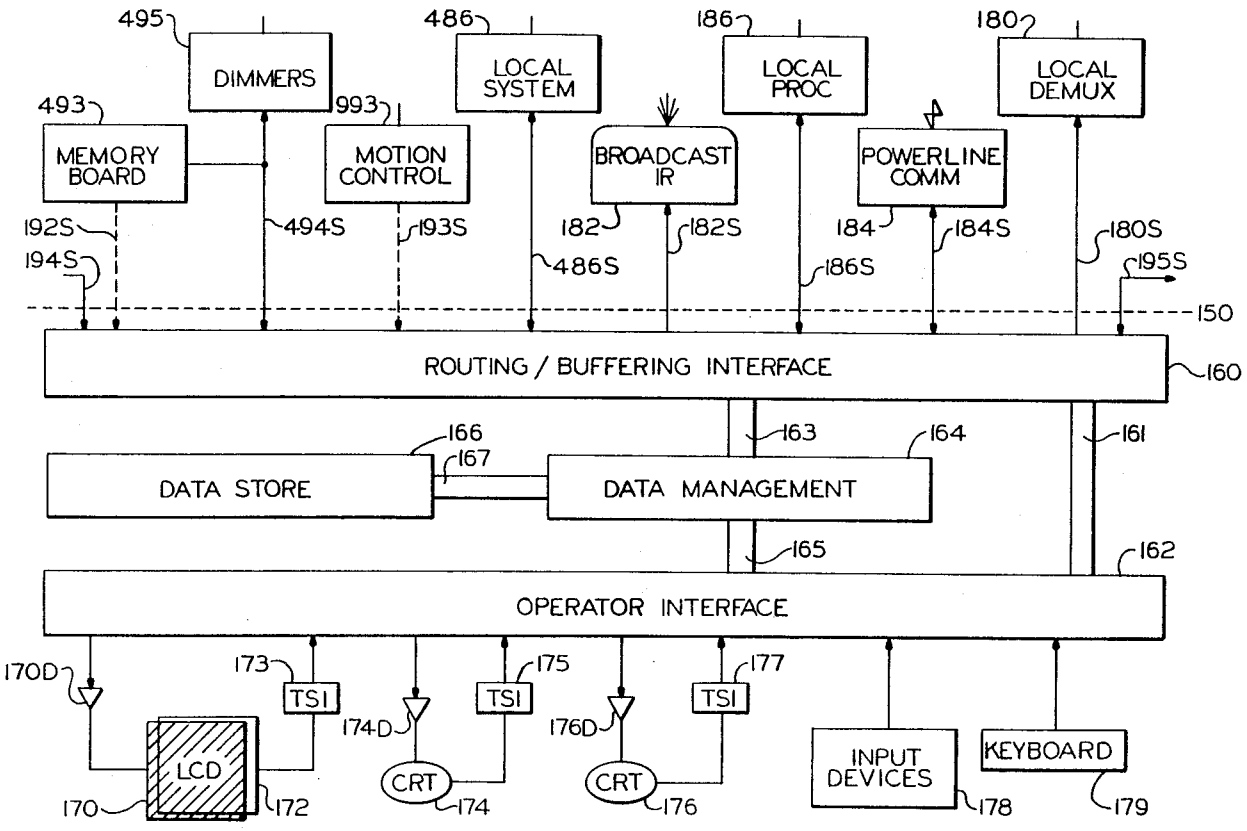
FIG. 11A is a block diagram of an improved control system suitable for use with the improved color mixing fixture of the present invention.
Figure 11B:
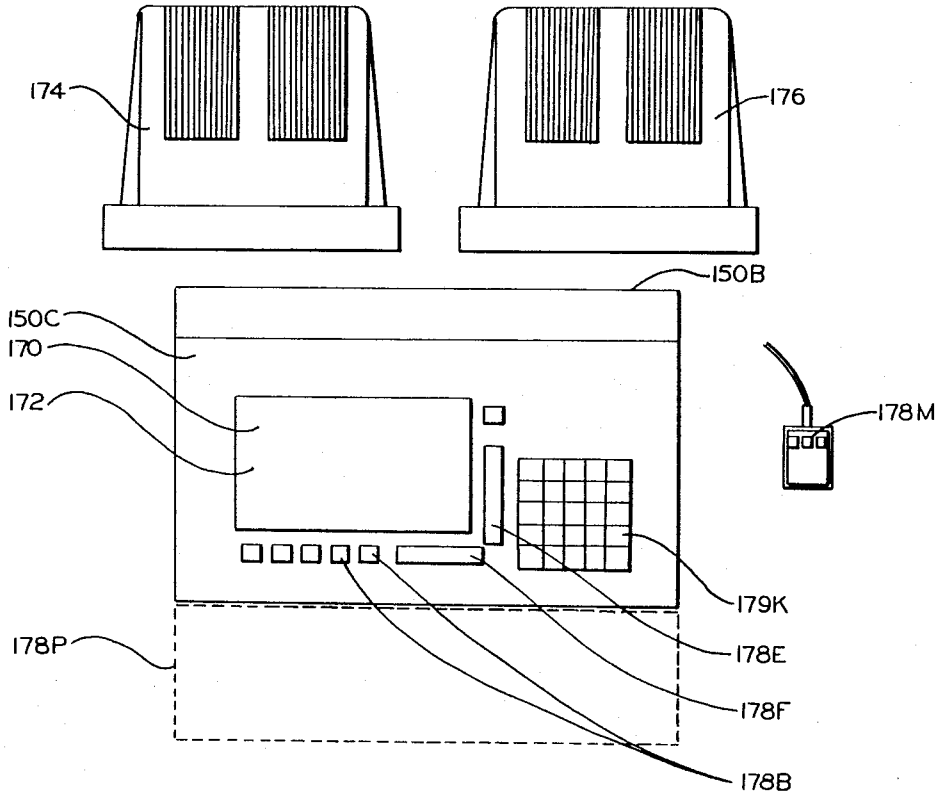
FIG. 11B is an elevation of one physical embodiment of the improved control system of FIG. 11A.

Refer now to FIG. 11A and 11B where such a control system with such features, and to FIGS. 12 through 18 where such an interface is illustrated.

Control systems for a plurality of beam parameters per fixture face a variety of problems either not encountered or not encountered to a similar degree by control systems for conventional fixtures that are adjusted only in intensity.

One class of such difficulties relate to the need to mix different types and generations of automated fixtures and devices in the same system; each having different control requirements dictated by the type and number of beam parameters adjusted and the type of mechanism used to perform each such adjustment.

Another class of difficulties relate to the variation in the total number of automated fixtures and devices that can be employed in a single lighting system and the effect on the demands made of the centralized portion of the system of such variation. For example, in some cases 12–24 such automated fixtures are used to supplement an otherwise conventional lighting system; in other cases 60–300 such fixtures may represent the vast majority of all fixtures used in the lighting system.

Another class of difficulties relate to the requirement posed by such automated fixtures and devices for transmission of large quantities of data to the many spaced-apart locations at which the units have been placed, particularly given the previously-described variations in the types and numbers of such fixtures and devices.

Many of these problems have been described in greater detail in the grandparent application.

Another class of difficulties relate to the frequent requirement that such automated fixtures and devices be employed in combination with a large and variable number of conventional fixtures adjustable only in intensity; and that the response of both groups of fixtures be synchronized to achieve a unified effect.

Many of these difficulties have been described in the parent application.

Further difficulties are a product of the technical and human factors problems of programming, storing, and displaying values corresponding to movement, color, locations in space, and time.

Refer now to FIG. 11A and FIG. 11B, where the basic features of a control system employing various techniques that address these difficulties is illustrated.

The centralized portion of this control system constitutes those elements below dashed line 150, which will be referred to as the "controller" portion. The controlled fixtures and/or devices will be referred to as the "devices".

The illustrated controller may be coupled to automated fixtures or devices that employ any one of three approaches:

Local system 486 constitutes a local control system associated with one or more automated fixtures or devices; the design and operation of which has been described in the prior related applications.

Local processor 186 constitutes a microprocessor or state machine associated with one or more automated fixtures or devices, as for example, disclosed in U.S. Pat. No. 4,716,344. While such an approach to the control of the device does not store desired parameter values for a plurality of lighting effects, and is provided primarily for actuator control, it does provide some local intelligence.

Local demultiplexer 188 constitutes a hardware decoder such as disclosed in U.S. Pat. No. 4,392,187 with no local intelligence.

Devices incorporating all three approaches must communicate with the centralized portion of a control system.

While FIG. 11A illustrates that, in functional terms, devices employing each of the three approaches may be separately addressed by the controller via 486S, 186S, and 180S; at the physical level all three can share a common data transmission means by employing a communications protocol that supports multiple message types.

Such messages may be readily produced by means of a function byte, as is, for example, provided for in the U.S. Institute of Theater Technology (New York, N.Y.) "DMX-512" digital serial protocol for intensity values.

In some prior art centralized systems, one serial message/packet is sent with the desired parameter values for each fixture. Because of the sheer volume of data to be transmitted, two problems have been encountered and recognized. One is the requirement for a high-capacity and yet reliable data link. The second relates to the perceptable "ripple" in the execution of a common cue by a large number of fixtures connected to a common serial link caused by the time required to send new values to each.

Another difficulty relates to the problems of producing changes in parameter values that take place at a rate slower than the maximum slew rate of the appropriate actuator In some systems, such changes are produced by the centralized portion of the system, which (in the manner conventional consoles produce timed fades in dimming systems) calculates and transmits the desired state of each parameter for each fixture at regular intervals during the transition; considerably increasing both traffic on the data link and the computational workload on the centralized portion of the system during such transitions In the illustrated system, desired parameter values for each fixture are stored in data store 166. The system identifies the type of controlled fixtures and devices by means of the "polling" function described in the grandparent application. Specifically, the controller sends out a message to each allowed device address whose function byte identifies it as a query Any device having that address responds with a message containing the codes representing the particulars of its design and operation.

This information is used by the console to configure the operator interface in the manner described below and to determine the responsibilities of console toward the device.

In the case of prior art devices with a local demultiplexer but no intelligence, a relatively simple hardware modification would permit them to respond to such a query. (The presense of devices that are not capable of responding or are on a simplex link can be deduced when the operator programs parameter data for them, and the input of data identifying the device can be made a precondition to the operator adjusting it.) On the basis of this identification of the device at a given address as having no intelligence, the controller understands that it will have to send parameter values as they are needed and calculate transitions for that address.

In order to eliminate the problem of "ripple" for local processor- and local demultiplexer-equipped devices, the illustrated system employs a technique disclosed in prior related application Ser. No. 443,127; the use of a separate "Go" command to initiate actual execution of a transition to values already present. Thus, the receipt of a message with desired parameter values by local processor 186 or by local demultiplexer 180 will not cause the initiation of a parameter value change—such initiation will be delayed until a common "Go" message is received by all connected devices.

Further, the selection of a new lighting effect at the controller as a pending "next" cue (whether by operator entry or its automatic loading as "next in sequence") will result in an automatic download of the associated parameter values to the controlled devices, such that the initiation of the next cue by the operator need only produce the "Go" message.

In the case of timed transitions involving either local control systems or local processor-equipped devices, the disclosed system downloads the duration value for the transition to the local system or processor, which is made responsible for metering the rate of parameter change to achieve that desired duration.

Identification of the device at an address as a local control system informs the controller that it can download parameter values for all cues to the device at power-up.

Therefore, the disclosed controller will respond to the loading of a cue into "next" position by transmitting messages with desired final parameter values and durations to only those addresses with local processors; and the first desired increment towards the final parameter values to only those addresses with local demultiplexers Upon the operator's initiation of the cue, the controller outputs a single "Go" message, which is sufficient to trigger the simultaneous execution of the transition to new parameter values by all connected devices having either local control systems or local processors. The controller may then devote its entire computational efforts and the data link to update messages to only those addresses with local demultiplexers.

The result is a uniquely flexible and efficient system that permits a controller and data link of relatively modest power to control a useful number of simple devices with no local intelligence; a larger number of devices with some local intelligence; an essentially unlimited number of devices with local control systems; and many intermediate mixes of the three.

The system disclosed in FIG.11A also employs three data communications methods.

Digital serial communication has been used in automated lighting applications for many years. It does, however, require the distribution of a low-voltage serial data stream to the various controlled devices and despite radiated EMI from the AC supply power wiring. Such distribution has required the use of special connectors and cables having no commonality with those already in use in conventional lighting systems; and in many cases the use of intermediate buffers. Therefore, the costs and practical difficulties of using automated fixtures and devices, particularly in large existing permanent installations, are increased significantly by the requirement for such cabling, connectors, and buffers.

The disclosed system employs a broadcast link between the controller and the devices. This may take any of many forms including an inductive loop around the space, ultrasonic or radio transmission, etc.. Preferably, however, a broadcast infrared system 182 is employed that pumps digitally-encoded data into the performance area from one or more emitters. Such an approach requires no special cabling or connectors, and as such, can be readily retrofitted to existing installations at minimal cost. Very high data rates and multiple channels are possible, and the link is immune to radiated EMI.

Such an arrangement has the disadvantage of being simplex in nature, but the disclosed control system overcomes this difficulty by the use of powerline communications.

The transmission of digital data through an alternating-current distribution system has long been known and several manufacturers offer integrated circuits for the purpose. Low-cost versions of such systems have limited data rates, typically less than 2kbaud, which is clearly insufficient for the data requirements of conventional control systems.

As taught in the grandparent application, the low data rates of the distributed control architecture disclosed in the prior related applications permits the use of powerline communication in such systems.

In the case of the control system of FIG. 11A, powerline communication is used to close the loop between the devices and the controller for devices employing all three approaches 486, 186, and 180.

Thus, the controller, when employing the broadcast link rather than (or in addition to) conventional cabling, uses powerline communication for responses from the devices. The "polling" operation takes place with queries over both the broadcast system 182 and the powerline system 184. A device that receives a query with its address over both systems responds with a powerline message. Receipt of that response by the controller confirms not only the presense of the device but the functioning of both systems. Receipt of the message by the device over only the powerline system results in a response to that effect, causing the controller to prompt the operator that the broadcasts are not being received and the device must be checked. Receipt of a query message on neither system will produce no response by the device and the refusal of the controller to accept parameter values for or adjustment of a device at that address until the user corrects the problem.

During operation, the powerline system is used primarily for reports and responses from the devices, although it can be used for duplicate "Go" messages and for other low data rate messages.

The disclosed system addresses the requirement for synchronized operation with conventional lighting fixtures by two means.

The controller may, of course, provide for storing desired intensity values for conventional lighting fixtures, and a unique interface mode will be disclosed for that purpose.

However, the controller also provides a synchronizing port for a conventional lighting memory console 493 as disclosed in the prior related applications. This port is illustrated as employing a simplex fiber-optic link 192S to the conventional memory console. A similar fiber-optic link 193S is provided to any specialized motion control system 993 provided for scenery and rigging automation. The function of link 993S will be described in greater detail below. The controller is passive with regards both these products (that is, the link is incapable of carrying messages to either console 493 or motion control system 993) and a fiber-optic link is employed to prevent a transmission by the controller, RFI, or an electrical fault from accidentally triggering a motion control cue.

A synchronizing port for other known protocols such as SMPTE, MIDI, and/or ESBus is provided via 194S.

The disclosed controller also provides for the control of the intensity of connected automated fixtures by an outboard conventional lighting control console as was disclosed in prior related application Ser. No. 443,127.

In the past, some control systems for automated lighting fixtures have sent one message for each fixture address, that message containing the fixture address and all parameter values including intensity. In the disclosed control system, intensity values are transmitted in separate messages/packets using a conventional format with intensity values for all addresses in a single message (e.g. DMX-512). Other parameter values are sent in other messages.

There are several benefits to this approach:

First, intensity values are more frequently changed and require faster response than values for other parameters. The use of specialized intensity messages that update all intensity values simultaneously maximizes the speed with which the fixtures respond to intensity changes. Further, when the output of the conventional console is accepted in serial form, no effort is required to strip each intensity value out, store it, and insert it into the next outgoing message to that address—and no delay is incurred in doing so. Instead, the serial output of the conventional console 493 can be coupled more or less directly to the data link to the automated devices, requiring only that the controller interleave its messages in the stream, omitting entire intensity messages as required.

Further, the address of the automated fixture for purposes of intensity control can, very desirably, be different from its address for other parameters.

Where the automation controller serial protocol is compatable with DMX-512, dimmers for conventional fixtures also be coupled to the same data link.

The illustrated controller provides an input port for the serial output of a conventional memory board 493 via serial link 494S.

Such an arrangement does not prevent the controller from determining and/or modifying intensity values, which can be readily edited between input from the conventional control console 493 and output to the automated devices.

Another benefit of the separation between intensity messages and parameter messages is the ability to reduce data rates by sending parameter values only when they change, or at least relatively infrequently. Because a parameter value message garbled in transmission will be held for some time (rather than being quickly corrected by the next transmission) error-checking is essential.

In the preferred embodiment, the disclosed system stores individual records of each change to a parameter value rather than recording the state of every parameter value of every fixture after every cue.

Each "record" in the data store includes six primary fields: the device address; the parameter affected; the new parameter value; the time required for the transition to that value; the event that initiates the change; and the delay, if any, between the event and the initiation of the change.

Such records can be indexed by device, parameter, and/or event.

The use of a separate record for each parameter of each device address for each event produces economy in storage; flexibility in adapting to different device types; and the ability to accomodate cues of exceptional complexity.

In the disclosed system, the current state of any device is a result of the last change to each controlled parameter, and the current state of the lighting system is a product of all previous changes executed. For this reason, new cues can be created and inserted in an existing sequence without affecting other devices or requiring the creation of "bridge" records for such devices, as the last value will "track" in the known manner. Further, changes in parameter value can be presented to the operator as abstract macros; that is, having defined a change of condition for one device, the operator can "copy" that change to any number of other devices. The operator can also copy such changes/macros with modifications including offsets.

The disclosed system also provides a serial port for data transfers with external devices via link 195S.

The adjustment of a plurality of beam parameters present unique problems with an efficient operator interface relative to those confronted by consoles adjusting only intensity.

To address these problems, the disclosed controller employs at least one interactive visual display.

In the illustrated embodiment, this takes the form of a flat panel display 170 (such as an EG8003 LCD unit as manufactured by Epson America Inc., Torrance, Calif.), which is driven by a Yamaha Display Master controller 170D (Yamaha Corporation of America, Buena Park, Calif.); and at least one conventional CRT (here, two CRTS 174 and 176) driven by any suitable display controller (174D and 176D). At least one such display is provided with a touch-sensitive surface 172 (such as manufactured by Carroll Touch Inc, Round Rock, Tex.) and its associated controller (173, 175, and 177). Many pointing technologies are possible including membrane, resistive, capacitive, and acoustic sensing of either the operator's finger or a stylus. Virtually all such touch input systems are provided as standalone units which output an X coordinate, a Y coordinate, and a presense signal. Several manufacturers supply software programs to produce a interactive visual display that may be directly interfaced with existing applications programs.

The disclosed system provides for one or more additional input devices 178, here including a three-button mouse. There is also provision for a keyboard 179.

Refer now to FIG. 12–20, where views of various screens that may be displayed by the disclosed system are illustrated.

FIXTURE SELECTION

The first requirement of the operator interface of an automated lighting controller is a means to identify and select the fixture or fixtures to be adjusted.

In virtually all prior art memory systems controlling conventional fixtures, adjustment requires the selection of the appropriate control channel by number. In conventional lighting systems the direction, color, size, and shape of each fixture's beam are fixed, so that the identification of each control channel is simplified by the fixed parameters of the fixture or fixtures it controls (e.g. Channel #54 is the Downstage Left Red Backlight). A written table or "magic sheet" that relates such names to channel numbers allows the user to determine the less memorable channel or fixture number from the function or name. Some such control consoles provide a method (whether handwritten labels in the case of manual consoles or alphanumeric capability in the case of some memory systems) to physically associate the two identifiers at the point at which the variable parameter is adjusted (at the fader) or displayed (on the CRT).

In an automated lighting system, multiple parameters of the fixture being adjustable, no such method of channel/fixture identification is possible. The fixtures may be identified by number, but such a designation has few associations for the user and hence takes considerable time to master, if, in larger systems, it is practical at all. Otherwise, the time-consuming consultation of a diagram of the lighting system to determine the number of the desired fixture is required.

As a result, U.S. Pat. No. 3,845,351 discloses a control console that disposes the fixture controls in a "dummy schematic of the arrangement of the floodlights" in the theater or studio.

In the Vari-Lite Series 100 automated lighting control system generally disclosed in U.S. Pat. No. 4,392,187, fixtures were selected for adjustment by means of a matrix of numbered pushbuttons 182, but when users were confronted by the problems of selecting fixtures solely by number in practice, the system was modified to provide a CRT display programmed with a simple schematic of the layout of variable parameter fixtures. The operator then selected a given fixture by the use of cursor control keys.

Figure 12:
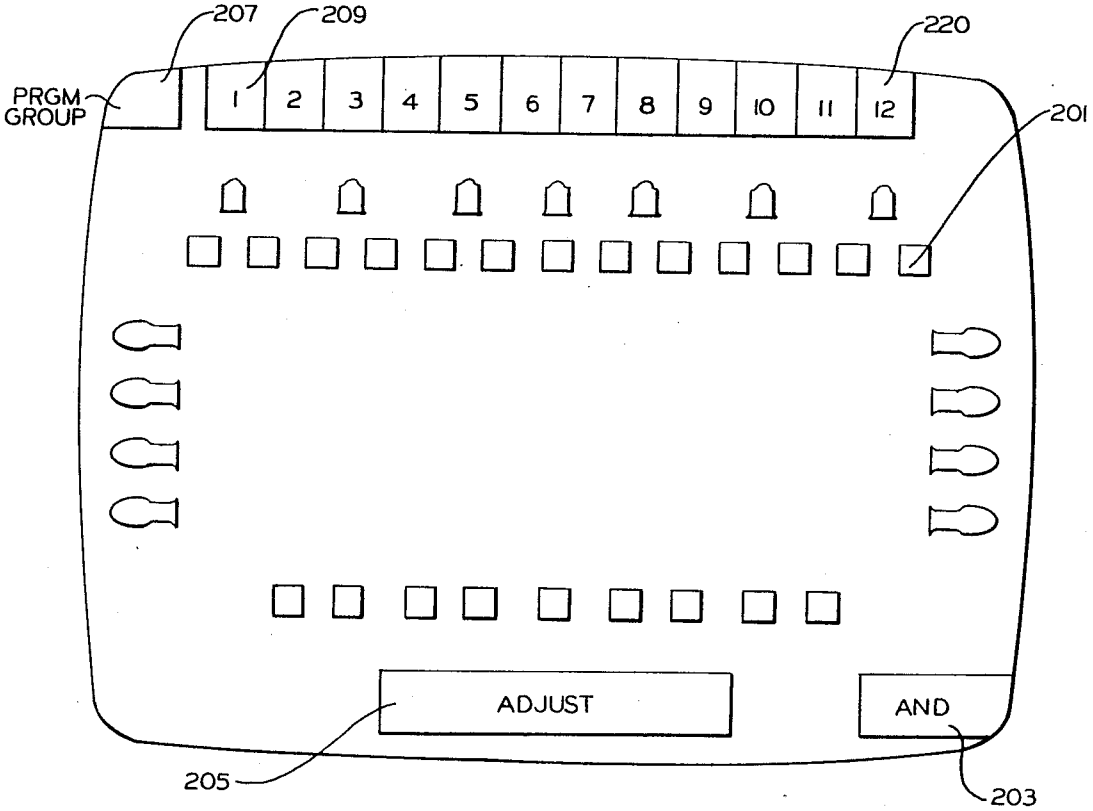
FIG. 12 is a fixture selection screen as may be produced by the interactive visual display of the improved control system of FIG. 11A and 11B.

As illustrated in FIG.12, the interactive visual display of disclosed control system presents a screen with a graphic presentation of fixture positions. The interactive nature of interface allows the operator to select the desired fixture simply by touching the appropriate symbol 201 on the display (or by designating it with the input device 178). The selected fixture may be indicated by flashing, reversed video, or a change in color or intensity. As illustrated, different types of adjustable fixtures may be indicated by different symbols.

A plurality of fixtures may be selected for simultaneous adjustment by any one of several methods. Given a Fixture Select Mode that automatically switches the display to a Fixture Adjust Mode upon selection of a fixture, the addition of an AND field 203 forces the display to return to the Fixture Select Mode. Alternatively, the interface may remain in the Fixture Select Mode until the use of an ADJUST field 205 to trigger the mode change, which would allow unlimited fixture selections.

Further, the illustrated interface anticipates the designation of groups of fixtures to simplify the programming of repetitive adjustments. By means of the PRGM GROUP field 207 the user can, by the same method of fixture selection described above, designate groups of fixtures and associate them with GROUP fields 209–220. These groups may be identified by a common, arbitrarily selected color, symbol, or brightness level. Thereafter, touching any GROUP field will cause selection of all fixtures in that group. Fixtures may be added to or deselected from a group for purposes of an adjustment operation without reprogramming them in the group store by touching (or designating) the symbols associated with the desired fixtures, toggling them on or off.

It will be understood that the selection process may be employed not just for variable parameter fixtures but for those varied only in intensity either by the same control system or by an external device such as a more conventional memory system via an interface.

The graphic display of fixture positions may be composed by the user in any known manner, in this case using the same "touch" process and/or the input device 178. Alternatively, the system may accept the direct entry of a display of fixture positions prepared by a drafting system such as Source Point TM, AutoCad TM, or Show Plot TM by means of disc, modem, or serial port 195S. Other benefits of the interaction between such drafting packages and the operator interface will be described.

It will be understood that a presentation of the entire lighting system may, in some cases, exceed the useable resolution of the display and/or the touch interface and, accordingly, zooming, windowing, and similar approaches may be employed for display management.

Upon selecting the fixtures to be adjusted in a given operation, the interface and display is driven to an Adjust Mode either by automatic means (a fixture selection) or by operator input (ADJUST box 205 or a actuator surface on the input device).

PARAMETER ADJUSTMENT

The design of the Adjust Mode display will vary as a function of the parameters to be adjusted and the type of mechanisms employed by the fixture for that adjustment.

Figure 13:
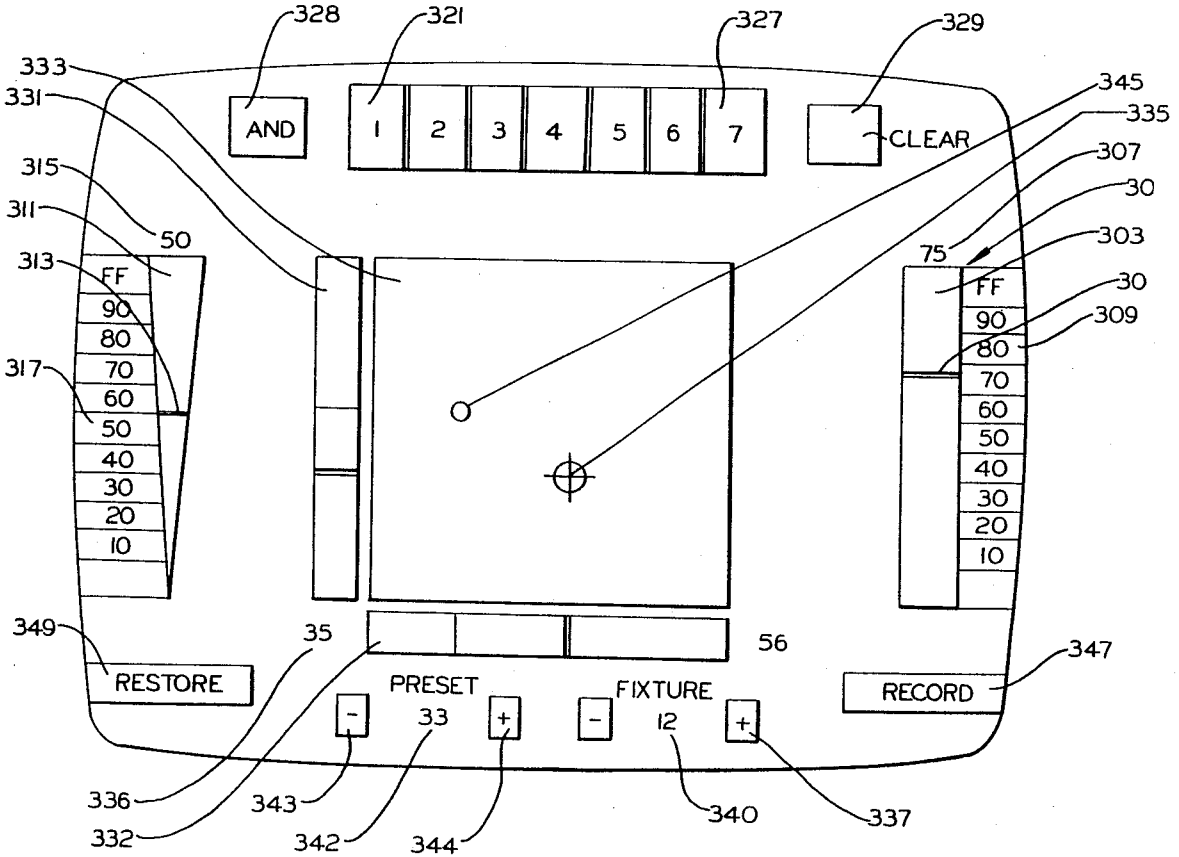
FIG. 13 is a fixture adjustment screen as may be produced by the interactive visual display of the improved control system of FIG. 11A and 11B.

FIG. 13 illustrates a single display screen suitable for the adjustment of all parameters of one type of multivariable fixture.

Intensity is adjusted by bar 301, whose graded intensity from bottom to top corresponds to the range of adjustment. Intensity can be continuously adjusted in analog fashion by touching or designating points along field 303, the current value indicated by a pointer 305 and by a digital display 307. Because it is frequently desirable to set fixtures to precise values, additional fields such as 309 provide a stepped sequence of fixed values. It is clear that a function can be readily be provided that allows resetting the assigned values.

Beam size, here shown as capable of continuous adjustment, may be selected by bar 311, whose shape illustrates the range of possible values. Again, the current value may be indicated by a pointer 313 or by a digital display 315. Additional fields such as 317 allow setting fixtures to precise sizes. Such fixed values may be reset to other values by the operator.

Beam color, here shown as adjusted by a semaphore type changer, may be selected by toggling on the fields for the desired color changer frames. To improve operator efficiency, the color of these fields 321–327 in the display, may be readily programmed to correspond to the color filters they control, preferably in a System Setup Mode, described below. The position of each filter may be indicated by partial or complete field coloring. An interlock function may-be provided to automatically cancel the previous selection upon a new one; an AND field 328 permitting multiple filter selections, and a CLEAR field 329 resetting all filters to the inactive position.

Beam azimuth and elevation may be adjusted by separate bars 331 and 332 similar to intensity bar 301 or size bar 311. Preferably, a field 333 provides a non-mechanical two-axis input device as disclosed in U.S. Pat. No. 4,460,943. Current azimuth and elevation may be indicated graphically by a moving symbol 335, or by digital displays 336 and 337 as disclosed in U.S. Pat. No. 4,527,198.

Other relevant data such as the fixture number 340 and the preset or cue number 342 may be indicated elsewhere in the display; and fields associated with them, such as fields 343 and 344 allow incrementing and decrementing them.

The illustrated operator interface allows the simultaneous display and adjustment of parameter values with high degree of operability, at equal or lower cost than prior hardware-oriented systems, and with a fraction of the maintainance requirement of such switch, indicator, and manual control arrays.

Further, the illustrated operator interface allows the simultaneous display of a previously recorded condition and of a new condition or adjustment prior to rerecording.

Consider, for example, the adjustment of azimuth and elevation for Fixture #12 in Cue #33. Upon selecting the fixture either from the Selection screen illustrated in FIG. 12 or by entering its number directly, the operator is presented with the display of FIG. 13. A symbol 335 provides a graphic indication of the recorded azimuth and intensity. The operator readjusts azimuth and elevation by use of field 333 in either the absolute or incremental modes described in U.S. Pat. No. 4,460,943. The new, temporary values are indicated by a second symbol 345 and, if the cue is active onstage, the fixture will assume them. Should the operator wish to rerecord the new value, he touches the RECORD field 347. The recorded position symbol 335 will replace the new value symbol 345 at the new values. If the operator wishes to retain the previously recorded value, he or she touches the RESTORE field 349 and the temporary value is cleared.

Another benefit of the illustrated operator interface is the unique ease with which the number, type, size, location, and design of the adjustment means can be altered to suit the needs of both the operator and the controlled device. Unlike prior art systems with hardware interfaces, the illustrated operator interface can be redesigned at insignificant cost, and indeed can be altered from moment to moment. In a system controlling a combination of color changers, remote yokes, and multi-variable fixtures, for example, the device selected by the operator can readily determine which of a plurality of Adjustment screens the operator is presented with, each such Adjustment screen optimized for the requirements of the particular type of fixture selected.

Figure 14:
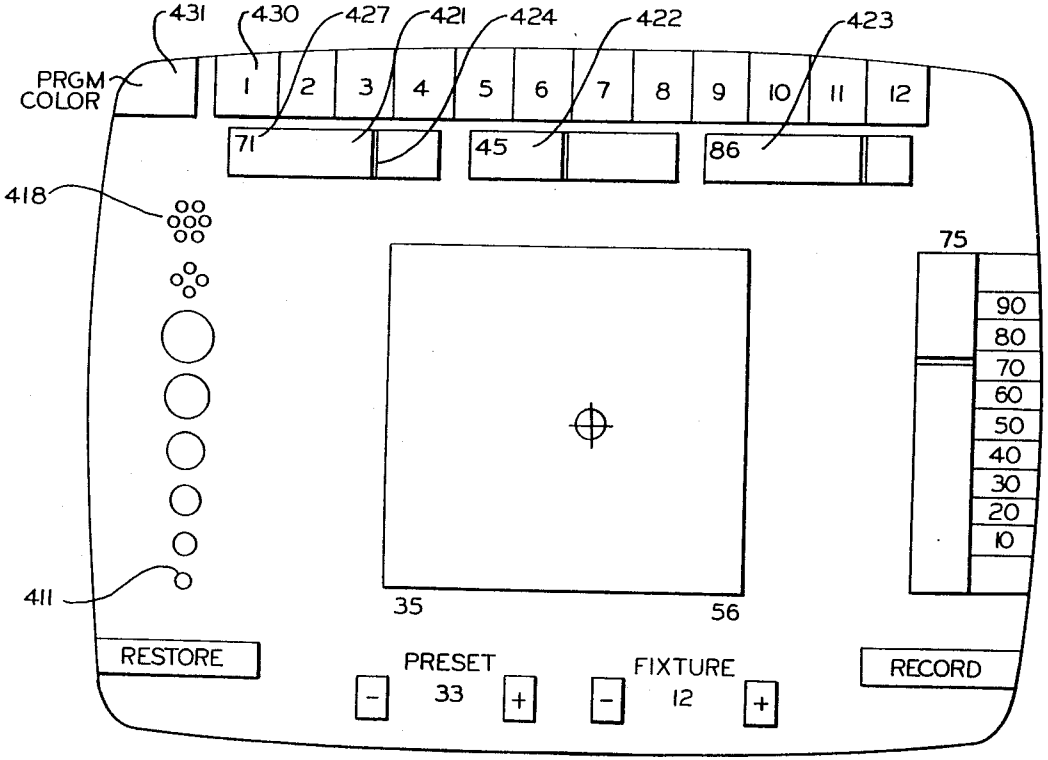
FIG. 14 is a fixture adjustment screen as may be produced by the interactive visual display of the improved control system of FIG. 11A and 11B providing for direct adjustment of the three additive primaries.

Refer now to FIG. 14 where the Adjustment Screen for another type of multi-variable fixture is presented.

Intensity is adjusted by bar 401 in a manner similar to that of FIG. 13.

Beam size is, however, adjusted in discrete steps by means of an aperture wheel, and as such, this section of the screen provides a series of fields 411–418 each corresponding to an aperture.

Beam color is adjusted by a continuously variable elements such as a trichromatic filter set, and accordingly bars 421–423 provide direct adjustment of each filter set with an analog display of the selected value by pointers such as 424 and digital displays such as 427. Because the operator will wish to program certain desired colors quickly and accurately, a series of fields such as 430 that may be preprogrammed with desired combinations of the three color variables using the PRGM COLOR field 431 are provided.

In addition to the separate adjustment of each filter in a system, color control adjustment may also be provided by a two-axis field in which both color and saturation are simultaneously adjusted (for example, by changes in location within a CIE chromasticity diagram) with software conversion to the required values for each filter. It will be recognized that a system that adjusts these two values directly, such as illustrated in FIG. 5A–10B, will require comparatively little conversion.

In FIG. 14, azimuth and elevation are adjusted in a manner similar to FIG. 13.

When the two types of fixtures are mixed in a common system, the selection of a fixture of a given type from the Fixture Selection screen of FIG. 12 will present the operator with the Adjustment screen appropriate to the type. It will be understood that fixture type may be manually entered by the operator, but is preferably performed automatically by the previously-described "polling" and responses from the fixtures and devices. Further, as has been previously described, the color filters and gobos installed in a fixture can be automatically identified by sensing either spectral transmission and/or codes of each filter or gobo and this information can be used to determine the color of the field associated with the filter and the symbol presented for the gobo automatically.

It will be understood that the display and adjustment of azimuth and elevation anticipates both the direct adjustment of these values and the adjustment of values corresponding to them but expressed as the absolute location in space at which the beam is desired. Such conversions, described in the grandparent application, may be performed centrally or at the controlled device in either the central or distributed architecture.

Figure 15:
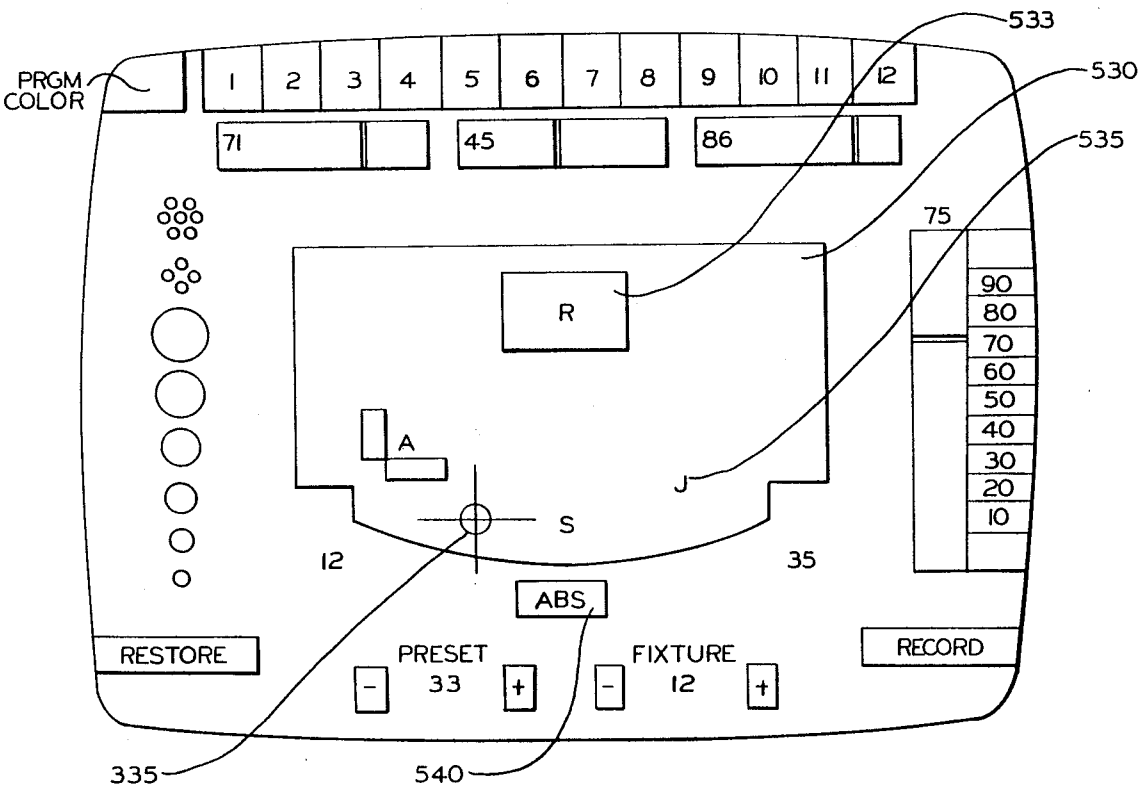
FIG. 15 is a fixture adjustment screen as may be produced by the interactive visual display of the improved control system of FIG. 11A and 11B providing for adjustment of the intersection of the beam with the stage surface.

In a system employing such adjustment, the desired azimuth and elevation may be programmed with the display of FIG. 15, the field 530 representing a diagram of the stage area, with or without rules or symbols identifying specific objects or locations on it. The operator, using finger, stylus, or input device, adjusts azimuth and elevation in the same manner as the previous Figures.

DISPLAY OF STORED PARAMETER VALUES

In a system employing the illustrated operator interface, the display of recorded values and particularly the adjustment of those values to create new stage pictures either in response to unpredictable developments in the performance or as a method of building new stage pictures is considerably simplified. Most prior art systems, if they are capable of displaying recorded values at all, are incapable of displaying them except in digital form, a form of presentation with little meaning for the operator.

A Stage or Preset Display screen, similar to that of FIG. 12 can graphically indicate the condition of the fixtures in a cue. Fixtures with beams shut off can be represented in outline only, while the symbols for active fixtures change to the color selected for those beams. The parameters of any fixture can, of course, be displayed by touching or otherwise designating the appropriate symbol, which presents the Adjustment Mode screen for that fixture with current or recorded values, and allows readjustment by appropriate operations in that mode.

Figure 16:
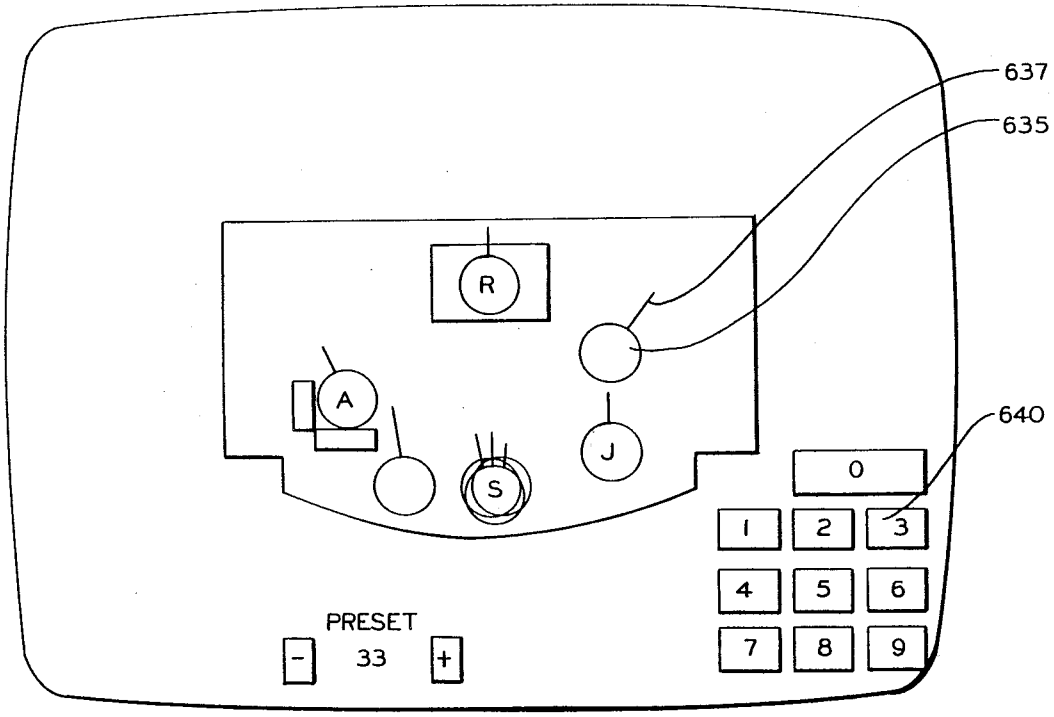
FIG. 16 is a cue preview screen as may be produced by the interactive visual display of the improved control system of FIG. 11A and 11B permitting the operator to determine the size and relative horizontal and vertical angles of the light beams illuminating any point on the stage surface.

However, in embodiments of the disclosed control system recording absolute values, another form of display as illustrated in FIG. 16 is also practical.

The recording of desired beam location onstage allows the display of such locations on a representation of the stage in the prior art manner. But a far more useful form of display includes not just position information, but other recorded values. Fixture symbols, such as 635 can adopt the color of the fixture beam (or an outline if the beam is extinguished) and change size according to recorded value (whether in arbitrary increments or by computation of beam spread).

To comprehend the visual effect of a given preset it is desirable for the operator to determine the direction from which each beam reaches the subject. In the only prior art system to graphically present beam location onstage, this requires identifying both the fixture responsible for lighting each subject from the identifying number within its position symbol; establishing the relative location of the fixture itself (by consulting memory or a drawing of the fixture layout); and then mentally comparing the two.

In the disclosed operator interface, lines could connect the symbol with a graphic display of fixture positions similar to that of FIG.12 superimposed over the stage diagram or wrapped around its perimeter. However, such a presentation would be cluttered. More practically, the desired information can be provided with a line such as 636 indicating the direction of the fixture, the line length varying inversely with the vertical angle to it.

MODIFYING RECORDED VALUES FROM A FULL STAGE DISPLAY

In the disclosed interface, the operator can select the fixture desired for adjustment by simply touching its beam symbol, changing its location by "dragging" it to the new one, and its remaining parameters by means of touch fields around the perimeter of the display. Preferably, upon touching the symbol associated with a given fixture, the display would change to an Adjustment screen such as shown in FIG. 15. When the operator removes his or her finger, the symbols for the remaining fixtures would return.

ENTRY OF SETUP DATA

The system of the present invention does require the entry of specific data identifying the fixtures used, their type, location, and for certain interface features, data such as color filter selections.

Figure 17:
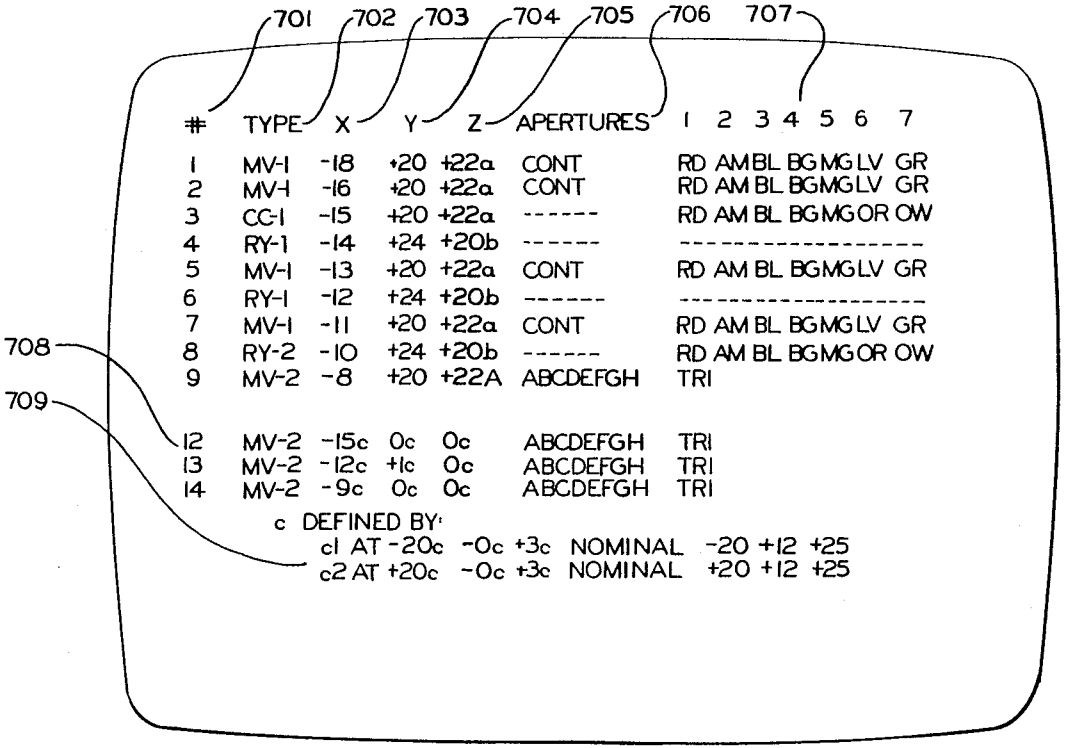
FIG. 17 is a device definition screen as may be employed by the improved control system of FIG. 11A and 11B to input the relevant specifications of each controlled device.

This data may be entered by one or more of several methods, and displayed in tabular form as illustrated in FIG. 17.

Controlled devices are identified by number in column 701 and by type in column 702. This data may also be automatically entered by one of two methods: the input of data from a drafting package such as previously described, or (as previously described) by querying controlled devices over the data link by number, the device assigned to a given control channel (by means of its local address decoder switch or function) responding with its type, model, and software revision as well as filter and gobo selections, where they can be sensed.

Device location may be specified in three dimensional space in columns 703, 704, and 705. The "X" dimension is distance stage left (+) or stage right (−) of the centerline. The "Y" dimension is distance upstage from the nominal front edge of the stage, and the "Z" dimension nominal height above stage level. Other notation systems are possible. Given these values, it is possible, as described in the grandparent application, to specify azimuth and elevation values in absolute position (with X,Y and implied or stated Z) and for the system to calculate the azimuth and elevation required to intersect that location. Entry of device location in numerical form also permits the automatic composition of a fixture selection display as shown in FIG. 12.

Further, it will be understood that automated drafting systems such as those described, by their nature, develop at least the "X" and "Y" values, and that the automatic input of data from such a system would include not only fixture number and type but available location values as well.

UPDATING OF POSITION DATA

Where devices are attached to a support (such as a truss) that may move with respect to the stage either from setup to setup in a touring production and/or for effect during the performance itself, updated position data is required for the absolute to azimuth and elevation conversion function. Where several devices are attached to a common support (hung on the same truss), the entry of revised position values can be simplified by designating those devices attached to the same support, here by means of the lower-case letter appended to the "Z" value. Thereafter, "Z" values for all devices in the "a" group may be modified by entry of "Za=24" "X" and "Y" values may also be updated in similar form.

A notation system that allows more complex movements of the support system is illustrated in the case of devices 12–14 identified as 708. Device position is specified relative to an arbitrary center point of the support structure. At least two points are specified whose position in absolute terms with respect to the stage is either known or can be inferred. In this case, these points c1 and c2 are preferably the motors used to raise and lower each end of the supporting truss, and their locations relative to the arbitrary center point are specified in the same terms at 709 (here shown as 20 feet from and 3 feet above center). The absolute location for the known points c1 and c2 are entered (here 20 feet to either side of center, 12 feet upstage, and 25 feet above it). Offsets relative to these known positions having been specified, the absolute location of any controlled device can be calculated. When the supporting structure moves, only the change in position of points c1 and c2 need be altered to update each device location.

It will also be noted that the position of the reference points can be determined with the aid of methods like ultrasonic ranging and angle or inertia sensors. As noted in the grandparent application, the location of fixtures can also be determined by manually adjusting their beams to intersect either a known location onstage or two points a known distance apart, a setup program allowing the system to calculate the location of the fixture in three dimensional space from the angles required. Given the known offsets of the remaining devices previously entered, the absolute location of any device or reference point can be determined.

As noted in the grandparent application, there are advantages to "jobbing out" the absolute to azimuth and elevation conversion to the local devices, and in such a control system, this notation system permits the updating of absolute position for all controlled devices in the "c" group with no more workload on the central system or data link than regularly transmitting three revised location values for c1 and three for c2.

Further, such updates can be provided automatically.

The chain motors supporting the truss, for example, may be equipped with encoders in the prior art manner, by which the "Z" location of the chain motor may be determined by a control system 993 for the motors. The improved control system disclosed anticipates automatically providing the same data to the variable parameter system via a data link 193S. Indeed, the improved system architecture disclosed in the prior related application may also include local control systems optimized for motion control rather than lighting control. The common data link between the various lighting and motion control local systems allows the synchronization of lighting and motion cues by outputting a common cue number from the supervisory unit. Similarly, running position updates used to maintain the focus of fixtures on moving supports with fixed subjects onstage, fixtures with subjects on moving scenic elements, and fixtures on moving supports with subjects on moving scenery may be transmitted through either the common data link or a separate channel. A degree of coordination heretofore unprecedented may therefore be achieved with minimal workload on the centralized portions of the system and on communications requirements on the buss.

Due to the dangers of the triggering of the wrong motion control cue or the correct cue at the wrong moment, whether by operator error or an electronic fault, the motion control system is separate from the lighting control system; connected by a fiber-optic or other link that will not transfer electrical noise or faults that might lead to actuation of the motion control system; and the operation of that link is entirely simplex, the motion control system 993 informing the controller of the execution of any cue and the location/status of its loads. The controller (and the memory board 493 for conventional fixtures) may, therefore, be triggered by the motion control system to produce a lighting effect in synchronism with a scenery move, but, as a matter of basic policy, the motion control system cannot be triggered by any operation of the lighting control system.

Similarly, where it is desirable to automatically track a moving performer and a system sensing the location of the performer is employed, position data produced by the tracking system may be employed by the variable parameter control system in the manner described.

PLURAL FORMS OF STORING VALUES CORRESPONDING TO AZIMUTH AND ELEVATION

It should also be noted that the improved control system disclosed ultimately anticipates the capability of storing for each device in each cue, a value corresponding to azimuth and elevation in any on of three selected forms: beam azimuth and elevation, absolute location, and symbolic location.

While absolute location storage does eliminate the requirement for rerecording every cue when the position of the fixture's support with respect to the stage changes (provided the fixture position is updated) there will remain certain cues (such as symmetrical arrangements of fixture beams in the air) that should not be "rescaled" from performance to performance; or which such a system of notation simply does not allow (such as beams focused into the ceiling). Therefore it is anticipated that the user may select either the azimuth and elevation or the absolute mode at the Adjustment screen level, by means of a field 540, the central portion of the display toggling between fields similar to those of FIG. 13 and FIG. 15 depending upon the operator's choice, the type of recorded value suitably identified in memory.

It will be further understood that most of the azimuth and elevation values entered by the operator (whatever form they take) are for the purpose of focusing the beam on a subject onstage rather than an absolute location. That is to say, his or her object is to direct the beam on a performer or a scenic element, an object which he or she attempts to meet by programming the values for the absolute location at which that subject is generally found. Yet during the course of the rehearsal of a presentation; during a series of performances; or during the performance itself, the location of the performer or scenic element may change. This change may come as the result of an accident; a deliberate alteration in the artistic design of the production; or to compensate for changes in the physical environment (e.g. a smaller or shallower stage). Rewriting those cues in which azimuth and elevation data must be altered to compensate is exceptionally difficult as no system storing azimuth and elevation values provides a ready means to identify which fixtures in which cues were focused on that subject.

For this purpose, the system of the present invention also anticipates recording azimuth and elevation values in symbolic form.

A symbolic value is one without fixed correspondence to either a specific absolute location or to azimuth and elevation setting.

A symbolic value would preferably be entered by the operator in alphanumeric form, permitting the use of abbreviations having associative value such as "DSC", "ActII/S3 Alto", or "Drums" although more concise arbitrarily-selected binary values might actually be stored.

Symbolic locations may be specified by selecting an absolute location on the stage by means of either the input devices or keyboard entry and by specifying the identifying code or abbreviation. These two values are entered into a lookup table. Thereafter, selection of that location for a given fixture in a given cue would result in the storage of the binary value assigned to that symbolic location, rather than the absolute location or the azimuth and elevation required to intersect it. Upon playback, the system, upon recognizing the value recorded for a given fixture as symbolic, would consult the lookup table for that symbolic value and pass the associated absolute values to the absolute to azimuth and elevation conversion means.

It will be apparent that this system of symbolic values allows the revision of recorded location data for any subject on the stage in all cues by the simple expedient of modifying the entry in the lookup table, with no search for or change of the actual fixture cue data.

It will be further apparent that the symbolic value provides a "key word" on which a search of the database that the cue data comprises may be simply organized, as limited by any other value or combination of values (e.g. Show all cues in which fixtures 1–12 are focused on the keyboard riser. Show all cues between cue 50 and cue 75 in which a light is focused on the conductor. Identify the cue in which one blue light and one red light are focused on the downstage area.)

It will also be apparent that the symbolic value system simplifies the "patching" of variable location data from an input (such as a moving performer or performer on a moving scenic element) to those fixtures assigned in a given cue to tracking that performer. By specifying the location as an input rather than an absolute position (e.g. Wagon3=Input4 instead of Wagon3 $=-14+21+1$) positional data can be automatically and constantly updated.

It will further be apparent that the symbolic system also provides a method of producing a "poor man's" absolute location to azimuth and elevation conversion method. Prior art approaches to the conversion of absolute location to the azimuth and elevation values necessary to intersect that location have been based on the real time conversion from one format to another at a fairly high update rate. This, in turn, produces a considerable processor workload which increases geometrically with the number of controlled fixtures. Preferably, this is performed by the local processor for each fixture. Where such a strategy is not possible (for example, in trying to "retrofit" this capability to fixtures having no local intelligence) and the centralized portion of the system must perform the conversion, it is clear that processor resources during a performance can be husbanded by "preconverting" the absolute locations to azimuth and elevation values prior to the performance for all fixtures whose own location will be known. But, as the number of locations to which a fixture beam will move in a show is generally far less than the number of cues, it is only necessary for the system to calculate the azimuth and elevation values required for each symbolic value for which the fixture is programmed, and to enter those values in a lookup table. This reduces both processing time and memory requirements of a "preconversion system". Clearly, the drastic reduction in processor requirements over a system which recalculates for all fixtures ten times per second provides enough unused processor power for those real time calculations that may be required by manual overrides of recorded positions.

PROGRAMMING TIME

It will be understood that the time it takes for the fixture to change between two sets of adjustments is frequently as important to achieving the desired effect as are the adjustments themselves. Conventional memory consoles employ a technique in which a "cue" defines the start of the change and a "count" specifies its duration, although this technique is relatively inflexible with regards more complex cues in which various changes start and end at different times with different durations.

In such systems, changes are assigned a start point with a numerical value (e.g. 35), the "cue number". New start points can be created between two already assigned by a "point" system (e.g. 35.5 can be inserted between already recorded 35 and 36), again conventionally. A duration can be associated with a given cue/start time (e.g. 35.5:3 is a change with a duration of 3 seconds starting at 35.5). In the disclosed system, such durations may be recorded for each change in a parameter by each fixture in the cue. As described in the grandparent application, applicant's improved architecture reduces the prior processor power constraints on such highly complex cues.

To increase the flexibility of the time notation system to accomodate more complex cue structures, a system should allow notation of start times relative to other start times (e.g. 35.5+4:3 is a change beginning four seconds after 35.5 and lasting three seconds). With such a system, highly complex effects can be designed with built-in synchronization between various fixtures linked to a common start point, using a more flexible system of time notation that permits different start times, durations, and end times. Further, the system should also permit substituting an event time rather than a duration for a cue (e.g. 35.5+2..35.6 is a change beginning two seconds after 35.5 and lasting until 35.6 starts).

GRAPHIC REPRESENTATION OF CUES AND CUE RELATIONSHIPS

The presentation of complex relationships between multiple cues, particularly in lighting control systems that permit execution of multiple cue sequences simultaneously, has been a difficulty since such control systems were first introduced.

Figure 18:
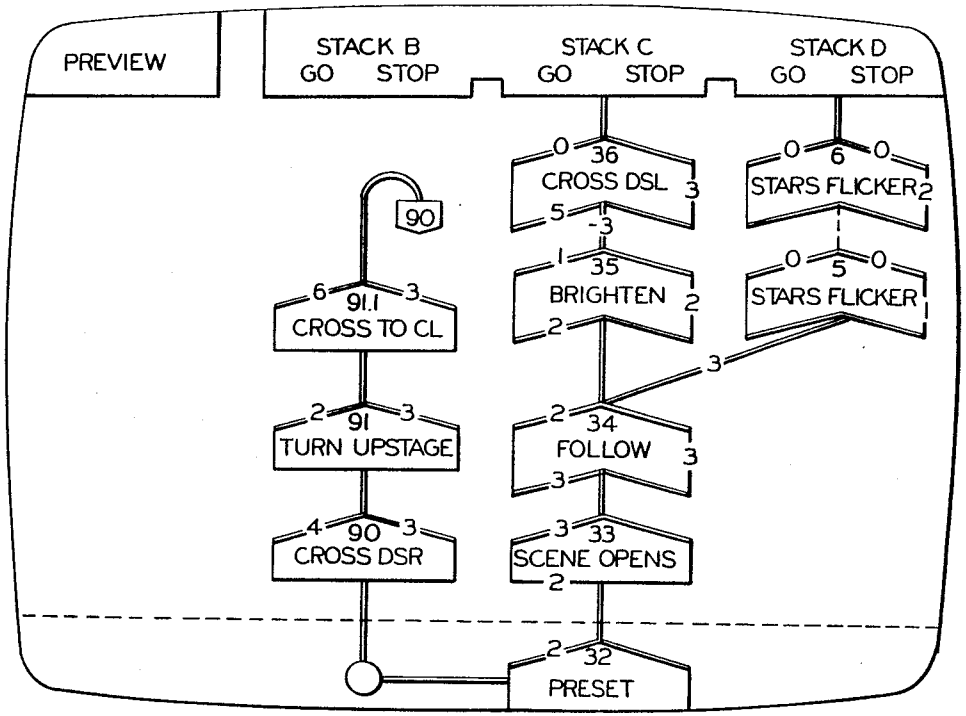
FIG. 18 is a graphic display of cue sequences as may be produced by the interactive visual display of the improved control system of FIG. 11A and 11B.

FIG. 18 is a graphic presentation of such cue sequences and their related variables that is more readily understood.

In the illustrated embodiment, each cue is represented by a graphic symbol. Those cues forming a sequence (whether by virtue of ascending numeric order or a specific "go to" or "link"), are disposed vertically along a common axis in a "stack". In the Figure, three stacks are pending.

The top edge of the cue symbol illustrated forms an arrow indicating the direction of the cue sequence, and the cue number is located under its point.

A field for an alphanumeric memo identifying the function, contents, or location of the cue in the production is also provided in the symbol.

The cue presently onstage is typically at the lower margin of the screen, here Cue 32, below the dashed line.

A cue that requires manual initiation is indicated, in this embodiment, by a symbol with a straight lower edge, as, for example, Cue 33 and the Cues 90–91.1 in Stack B.

A cue that will automatically trigger from a previous cue is indicated by a symbol with a chevron shape.

The illustrated cue symbol also provides for numeric values representing conventional in-times, out-times, waits, and durations. In the case of the cues in Stack C, the in-time value is located in the bottom edge and the out-time value in the top edge of the cue symbol. An alternate location for these values is illustrated in the case of Stack B and Stack D, the out-time being located to the right side of the top edge of the cue symbol.

Where the duration that the cue is onstage is specified, this value is illustrated as appearing in the right side of the cue symbol.

Where there is an offset between the initiation of the "fade-out" of the previous cue and the "fade-in" of the new one, that offset is indicated in the illustrated embodiment by a value on the vertical line linking the two cues.

FIG. 18 also illustrates how the disclosed operator interface uniquely clarifies complex relationships between multiple cue sequences. Cue 34 has been linked to both Cue 35 and Cue 5 such that executing the "fade-out" of Cue 34 will result in not only a 2-count "fade-out" of Cue 34 and a 2-count "fade-in" of Cue 35 but, after a 3-count delay, a 0-count "fade-in" of Cue 5, leading to the simultaneous automatic execution of the cues in both Stack C and Stack D. Similarly, the execution of Cue 32 has caused the system to load the cue sequence beginning with Cue 90 into Stack B, although, as can be seen by the shape of the symbol, Cue 90 will not proceed until initiated manually. Further, after executing Cue 91.1, the screen indicates that the system will loop Stack B back to Cue 90.

The function of the illustrated screen extends beyond depicting the relationship between cues. The interactive capability of the display permits the user to "scroll" forward and backward through the cue sequences by, for example, touching any blank area of the screen/display to "grab" it, and then stroking the display upwards or down. Fields can also be provided specifically for the purpose. The next cue in a stack can be initiated or a running cue halted by means of a corresponding field, here located along the top edge of the screen/display and/or by touching the cue symbol itself.

The illustrated embodiment is capable of multiple modes, determining the effect of touching or otherwise designating a cue symbol.

As indicated by the mode field in the top left corner, the illustrated screen is currently in the Preview mode. This mode permits the user to display the contents of any given cue by touching its symbol. The visual display, or preferably another visual display, presents the parameter values for that cue for review and/or modification.

Modification of cue times, memo fields, and other data related to the cue itself can be performed at a Cue Preview screen such as illustrated in FIG. 16. Preferably they can also be modified from the Cue Sequence screen. While this could be performed with a mode change, preferably one side of the cue symbol is defined as being "Preview" and the other "Modify" Touching or otherwise designating the "Modify" side of the symbol will present the current values associated with that cue in the same or another display for modification, for example, as in the manner of the various prior screens. Given a pointing means with sufficient resolution, the operator can touch the displayed value he or she wishes to edit. Similarly, the user can establish links not only by numeric entry, but by simply "drawing" them on the display.

The screen illustrated in FIG. 18 employs only one of several possible approaches to the graphic display of cues, cue times, and cue relationships.

It will be understood that the time values of cue transitions, waits, and durations can themselves be depicted graphically, such as by employing the vertical axis of the screen as a proportional time line.

Consider, for example, the symbols in FIG. 18 associated with Cues 33 and 34. The "fade-out" of Cue 33 is a 3-count, the "fade-in" of Cue 34 is also a 3-count and there is no offset or "wait" between them. These values could be represented by employing for the top edge of the symbol for Cue 33, an upward-slanting line whose slope is proportioned to the "fade-out" duration, and a corresponding shape for the bottom edge of the cue symbol for Cue 34, such that the two edges nest. The slope of the interface between these symbols would be greater than that of the interface between Cue 32 and Cue 33, which involves a 2-count transition. The top edge of the symbol for Cue 5 and the bottom edge of the symbol for Cue 6 would both be straight as their time values are "0", but there would be a one-unit gap between the adjacent edges of the two symbols due to the 1-count "wait" between them. Unequal "in-times" and "out-times" would result in adjacent cue symbols with edges not parallel, the relationship between their respective times and "wait" value (if any) producing a partial overlap between symbols and/or a gap of varying size, which represents a uniquely useful visual metaphor for the effects of such transitions. Similarly, the height of the parallel-sided portions of the cue symbol can correspond, in the case of cues with preset durations, to the programmed duration value. It will be recognized that the time scale to vertical display height unit correspondence can be non-linear so as not to consume excessive display height in the case of longer cues and transitions, and that break lines can be used for cues with durations above a certain value.

The values for transitions, waits, and durations can be modified not just by conventional numeric entry but by "grabbing" the cue symbols on the display with a cursor or pointing device and stretching them in the vertical axis.

In the case of systems based on storing "changes" rather than "presets", and particularly in the case of the disclosed control system, which is capable of storing individual durations and "wait" times for each parameter change for each cue/event, the top level cue sequence screen can be simplified.

PROGRAMMING WAYPOINTS

It will be understood that, in addition to programming point-to-point transitions per se, that the operator may wish to specify the route or trajectory that the beam will follow between points, in order to follow the motion of a performer or scenic element; to avoid illuminating a performer or object between the two endpoints; or simply for aesthetic effect.

Such a trajectory could be manually entered and stored in digitized form, however, at a considerable cost in memory. Preferably, however, the operator will specify waypoints that define the trajectory, the system generating the stream of azimuth and elevation values required to link the desired waypoints.

It will be understood that it is also desirable to specify the time between each of the waypoints as a method of allowing the operator to vary the rate at which the beam navigates the stored trajectory.

PROGRAMMING SUBROUTINES

In addition to programming beam movements in terms of desired positions, it will be desirable to provide a method of specifying beam motions per se, such as circles and ellipses, by the location of their centerpoints and the dimensions of their axes. This allows the operator to quickly and precisely specify apparently random motions of the beam. Such subroutines are preferably performed by the local control system or motion control hardware associated with each fixture with only a call of routine type, speed, centerpoint, and dimensions from the supervisory level of the system, minimizing the workload on its centralized portions.

Regular changes in beam color, size, or intensity can be treated in a similar manner either by association with motion control routines or as separate routines of their own.

PROGRAMMING BOUNDARIES

It will further be understood that absolute location boundaries may be specified that limit the movement of beams. For example, during manual adjustment or a programmed movement, the beam from a fixture may strike a camera lens, stray beyond the stage area, or illuminate an unattractive piece of scenery or stage equipment. The operator may enter the absolute locations of such "off-limits" areas into the system using a display mode similar to that of FIG. 15. When comparison of the absolute location of a fixture beam with this "stencil" indicates that it has reached such a boundary, the beam may be redirected or, more simply, shut off while it transits the "off-limits" area.

PROGRAMMING SIZE/COLOR SYMBOLS

Returning to FIG. 17, one method of entering the data required for display of the appropriate color and beam size symbols in the Fixture Adjustment mode is automatic; the response to "polling" on power up may, as previously described, provide fixture information including the type of beam size/shape and color varying means provided. While this response may be sufficient to identify a fixture as having continuously variable size adjustments versus an aperture wheel, or a six-color semaphore changer versus a trichromatic system, it will not be capable of identifying those apertures or those colors when they can be changed—unless an automatic capability for determining the current selections (as previously described) has been provided. Where such capability has not been provided, the operator must enter the necessary information In the case of apertures or gobos, the relatively limited number of available alternatives suggests that symbols like 411–418 may be resident in the system under identifying codes corresponding to the ordering code identifying the gobo. In the case of color, the ordering code for the filter material in each changer position may be entered, but as only a relatively limited range of colors is necessary for actual display, the conversion between the ordering code and the displayed color performed at setup by a lookup table. Alternatively, the operator could specify the display color preferred either as an alphanumeric value or by selection from an onscreen palette. It will be understood that this information could also come from the offline use of a lighting drafting/paperwork system as previously described.

PROGRAMMING LOCATION SYMBOLS

The programming of symbolic locations that correspond to a variable absolute location has been previously described. These symbolic locations can be represented on a display screen by the alphanumeric codes specified by the operator. They can, however, also be represented by a graphic symbol, just as the shape of a particular gobo is represented graphically (for example, as illustrated in FIG. 14). With a simple drafting or sketching program producing compatable entities, the user can compose a graphic symbol for each symbolic location having the best associative value. These entities will then appear at the absolute locations currently defined for their symbolic values in a screen display of absolute locations such as FIG. 15. However, there is no requirement that all display screens place such symbolic locations in current absolute relationships. To the contrary, the user may also design more abstract screens with little or no such literal correspondence to absolute location (equivalent to the well-known "magic sheet") by dragging symbols to the desired screen location. The disclosed interface can support such "magic sheet" displays with the simple expedient of providing additional fields in the symbolic location record for the screen location of each such symbol in each such abstract screen display.

It will be recognized that the display of the absolute or symbolic location onstage that a fixture beam intersects is not limited to fixtures with remote azimuth and elevation adjustment capability, but that the user can manually enter the location at which conventional fixtures with no such remote capability have been focused so that the effects of their intensity adjustments as well as the adjustment of any other variable beam parameters (such as color by a color changer) can be integrated into the various screen displays.

It will also be apparent that symbolic "magic sheets" can also be used in systems controlling only intensity to provide a far more natural interface than the entry of channel numbers traditionally employed. Unlike the system disclosed in U.S. Pat. No. 4,703,412, the "magic sheet" such as illustrated in FIG. 3 or FIG. 4 of that application can be readily produced on a CRT or other electronic display, and the operator employ either a "touch" interface or a pointing device such as a digitizing tablet or mouse, to designate the desired group of channels/outputs for adjustment. Such a display can use colors corresponding to those of the controlled fixtures;

be automatically updated to reflect their current status; be readily changed and modified as desired; and can be stored with the cue data for subsequent reuse. Further, while the system disclosed in that patent permits the operator to use a hard copy "magic sheet" on a digitizing tablet to bypass channel numbers for entry, it still employs such numbers and the conventional matrix display of intensity values of FIG. 7 (as was first disclosed in U.S. Pat. No. 3,898,643). The operator must, therefore, continue to mentally convert channel numbers to functions in order to determine the current status of the system both during the process of writing cues and of subsequently reviewing them.

By contrast, the disclosed interface permits a graphic display of system status (by, for example, presenting the symbols for inactive channels in outline and those at level filled with the color of their beam) permitting the operator to instantly grasp system status The percentage value of active channels can further be presented numerically within the symbol. Such an approach obviates the need for the operator to employ channel numbers at all and represents a far more efficient solution to the problem.

PHYSICAL EMBODIMENT

A plan view of one physical embodiment of the improved control system is presented in FIG. 11B.

A console 150C mounts a flat panel display 170 and associated touch screen 172 previously described, along with a keypad 179K providing number and certain basic function keys for rapid entry of numeric values. Known linear touch encoders 178E and 178F are provided for rapidly incrementing values and for "scrolling" the field of view of display 170. Hardware pushbuttons with a crisp tactile feel 178B are provided along the lower edge of display 170 for functions (like the step advance of cues or chase sequences) that require such tactile feedback. At least one input device suitable for pointing in two or more axes, here three-button mouse 178M is provided. Two multi-sync color monitors 174 and 176 are provided. Input and output connectors are mounted on the rear surface 150B of the enclosure 150C. A "beard" enclosure 178P having linear faders for use as scene or matrix masters can be added at the lower edge of the console enclosure 150C when desired.

Internally, many hardware and software designs for the improved control system of the present invention can be employed and, as a consequence, FIG. 11A illustrates the functional organization of the system.

Four major functions are required.

One is the Data Management function 164.

The disclosed system constitutes a database management system including the following record types:

A Parameter Change Record (PCR) is provided for each parameter value change for each fixture. A PCR is a record of at least 64 bits including the cue number (15 bits); cue group (4 bits); fixture number (9 bits); parameter identifier (4 bits); parameter value (10 bits); change duration (12 bits); delay between cue and change initiation (10 bits). A single parameter value field suffices for most parameters including symbolic locations. Azimuth and elevation, absolute location, and unconverted three-value additive and subtractive color values require additional fields and such PCR records (recognized by their parameter identifier value) provide two additional 16 bit fields for a 96 bit length.

Each parameter change can optionally be assigned to any one of up to sixteen cue groups within a cue number. These subgroups within a cue can be used to simplify subsequent modifications to cues, cue times, and cue execution.

The default duration and delay time values are "global", that is, the time values assigned to the cue itself (or the group within the cue). All PCRs with specified durations and/or delays are, therefore, exceptions to the global cue times.

A Cue Record (CR) is provided for each cue or group in a cue referred to in a Parameter Change Record (PCR).

The Cue Record includes fields for the cue number and group; an alphanumeric memo field (0–32 characters); global duration; global delay; the "link from" or prior cue in the sequence (default value: the next lower cue number in use); the event that triggers the execution of the cue (manual input; SMPTE, MIDI, or motion control output; defined delay after the execution of the previous cue).

A Symbolic Value Master Record (SVMP) is provided for every symbolic location value referred to in a Parameter Change Record (PCR). It includes at least the internal code used to represent the symbolic value; the operator-defined alphanumeric identifier; a pointer to the file with the graphic symbol, if any, displayed for the symbolic value; the X, Y, and Z absolute values of the symbolic location; and the starting and ending cue numbers for which the record is valid. Thus, several different Symbolic Value Records can be used to reflect simple changes in the absolute location of a symbolic location during a performance (for example, with the movement of an actor or piece of scenery). As has been described, absolute values for symbolic locations can also be "patched" to external devices (such as the mouse 178M or motion control system 993) that update the current absolute location.

A Device Master Record (DMR) is provided for each fixture that is under the control of the system. The Device Master Record includes fields for the fixture/device number; its type (which also serves as to identify the graphic symbol used for its display); its X, Y, and Z locations in space; and the support to which it is attached (which, as has been described, can be used to modify location data).

A Device Supplemental Record (DSR) is provided for each variable parameter of each controlled fixture. The Device Supplemental Record includes fields for fixture number; parameter identifier (the same 4 bit value used in the PCR); a code for the mechanism employed; the allowed range of adjustment values; and the display attributes for representing each value It is the Device Supplemental Record that is used to configure the operator interface. The mechanism code points to the graphics file with the symbols presented for adjusting or displaying parameter values on the display (for example, the fields 321–329 for the semaphore color changer of FIG. 13 versus the fields 421–431 for the three-color system of FIG. 14). The allowed range fields can be used to set boundaries as previously described, or, with the benefit of feedback from the device, to reflect a physical limitation imposed on the device's mechanical travel by, for example, an adjacent obstacle. The display attribute fields are used to specify, for example, the colors that will be displayed within the fields 321–327 of FIG. 13 or the aperture symbols 411–418 of FIG. 14. While the database system anticipates the ability to store individual such variables for each parameter mechanism, more commonly, the Device Supplemental Record will use default values for each defined mechanism or subgroup of devices employing that mechanism, permitting a single selection and display attributes file to serve for all such mechanisms or mechanism in that subgroup.

It will be apparent that the storage and manipulation of this database can be performed by many known hardware and software combinations. A Data Store 166 such as a semiconductor memory and/or hard disc will be provided for mass storage of records. A means suitable for use as a data carrier such as a floppy disc drive or a memory card system will also be provided.

The second major function is the Routing/Buffering Interface 160.

This function includes the basic communications functions (corresponding to the lower levels of the ISO OSI model) associated with maintaining the serial interface across dashed line 150 between the centralized portion of the system and the various controlled devices and external sources of input.

While this function can be performed by the general system, it will be recognized that one or more intelligent interface subsystems can bear most of the basic communications workload, and do so in a manner (particularly given the use of data buffers) that considerably simplifies the design and improves the efficiency of the system as a whole. Further, the use of intelligent communications subsystems permits the support of different manufacturer-specific communications protocols by employing a separate such subsystem for each.

Further, certain communications tasks (such as the previously-described incorporation of serial intensity values from an external lighting control console 493) need not, in fact, require the participation of the system as a whole. To the contrary, by performing this routing entirely within the interface area, such as within one or between a pair of intelligent interface subsystems, the workload on the other portions of the system (such a that performing the Data Management function 164) can be further reduced. Such an arrangement does not, of course, prevent the passing of intensity values to and from other portions of the system.

During certain operations, the Routing/Buffering Interface 160 acts in concert with other functional areas, most frequently the Data Management function 164.

Dedicated intelligent communications controllers are available for many micro-computer bus systems, including the IBM "PC/AT" bus, most notably for the support of local area networks. Serial interfaces are well known in the lighting control art and additional prior disclosures include U.S. Pat. Nos. 3,845,351, 4,095,139, 4,392,187 and EPO App. No. 0 253 082 A2.

The third such major function is the Operator Interface 162.

The interactive operator interface disclosed employs known displays (such as the previously-identified flat panel and color CRT displays) and known display controllers such as those EGA, VGA, and PGA cards available for the "PC" bus.

As previously noted, several manufacturers of touch interface hardware (including MicroTouch Industries, Woburn, Mass.) offer software programs representing a readily customized screen graphics design and touch field definition interface to user applications programs. Those such programs based on commercially-available graphics description languages (such as the Halo TM package of Media Cybernetics, Inc., Silver Spring, Md.) offer the possibility of interchanging symbols, screens, and files with off-the-shelf drawing and CAD drafting programs based on the same graphics language system.

Associated with the Operator Interface function 162 are the various graphics files associated with screen and symbol generation.

A lighting memory system employing a very basic form of interactive display is disclosed in U.S. Pat. Nos. 3,898,642, which was reduced to practice as the Skirpan Auto-Cue TM.

The fourth such major function is an overall system controller responsible for general housekeeping and for regulating overall operation of and the exchange of data within the total system. This function can be performed by any known micro-processor system, employing either custom hardware as disclosed in any of the prior references; or an established micro-computer bus system such as known industrialized "PC/AT" bus systems based on the Intel 80286 and 80386 processor.

The operation of the disclosed embodiment will now be briefly described with reference to the various Figures.

PHYSICAL SYSTEM DEFINITION

At power-up, after initialization, the system controller, via the Operator Interface 162, asks the operator via one or more displays 170, 174, and/or 176 whether an existing show is to be loaded or a new show created.

If the operator selects "New Show", the system asks the operator whether the definition of the physical lighting system is to be loaded from an existing file.

If the operator responds "no", the system controller instructs the Routing/Buffering Interface 160 to begin polling the connected devices 486, 186, and 180 via their serial link. In the manner previously described, the system will poll each device address and, upon receiving a response at an address, will instruct the Data Manager 164 to enter a Device Master Record (DMR) for that address, and a Device Supplemental Record (DSR) for each parameter identified as controlled, along with all available information on the selections available for that parameter. Where information is not available over the serial link (because, for example, a fixture cannot return its gobo selection automatically), the field is left blank, and will remain so until entry is effected by another means. Following the completion of the polling process, the system database will include Device Master Records (DMRs) and Device Supplemental Records (DSRs) for each responding device.

A housekeeping utility associated with Data Manager 164 can scan the record sets and prompt the operator for variables not available.

The selection of a device with undefined display attribute fields for its color changer would result in a display such as FIG. 13, whose color fields 321–327 are numbered and presented in outline, but not colored. Upon selecting such a device, the operator can be offered the opportunity to enter color attribute values by, for example, selection from an onscreen palette.

Similarly, as previously described, such "polling" will not find devices incapable of response, for which the user can be prompted to enter the information required for an MDR and SDRs when he or she first seeks to adjust the device by numeric entry of its address.

The absolute location of a device can be entered manually, or, where the operator has used a CAD package to produce a "plot", the disc with that file can be inserted in the console disc drive and read to enter the absolute locations of the devices into their MDR records.

Similarly, scale drawings/databases with the views of the performance area/set itself can be loaded.

The function of a CAD package can be extended to include the specification of all relevant data about the devices, which can be expressed in the form of compatable MDR and SDR records.

If the operator responds "yes" at the "Load Physical System Definition from Disc?" prompt, the MSRs and SDRs are loaded directly from disc (whether generated by such a compatable CAD package or a prior show) and, in this case, (or that of loading an existing show from disc by choosing to do so at the first prompt), the purpose of the serial poll is to find any discrepancies between the database records and the responses from the actual devices, and to generate a report of such discrepancies for the operator.

DISPLAY MODES

With the MDRs and SDRs defining the physical lighting system entered, the process of entering cues can begin.

While the function of various displays and input devices are readily changed, frequently CRT 174 will be used to present Device Selection screens. Such screens can take the form of a two-dimensional plan view as illustrated in FIG. 12. It will be recognized that MSRs represent a three-dimensional, object-oriented database that may be used with a standard CAD package to develop a three-dimensional presentation of the physical lighting system. This permits the user to define a "point of view" in addition to plan view, such as one equal to the current console location, that provides a more useful presentation of the physical system. Further, as has been described, the user can also create more abstract representations of the lighting system.

Frequently, CRT 176 will be used for Device Adjustment screens such as illustrated in FIG. 13, 14, and 15.

Frequently, the flat panel display will be used for one or more of the following functions:

As a virtual control panel with additional actuator surfaces and displays required by the current mode.

As a display of the contents of a record.

As an additional display for any of the illustrated screens.

As an interactive, graphic flowchart that presents the user with the options available at each step during an operation, and permits the user to make choices by touching or designating the appropriate symbol.

OPERATING MODES

During operation, the physical lighting system reflects the result of all previous cues. By updating a "Stage" file with each parameter value sent to the devices, the control system will have available a single file that reflects the current state of the physical system such that the control system can display it as well.

Clearly, discrepancies can arise between the current state of the physical system and its desired state as reflected in the "Stage" file. Once the message to initiate each cue has been sent to the devices, the system waits for a time equal to the greatest total of change duration plus initiation delay in that cue, and then sends a general "Cue Complete? " transmission to all devices. The control system associated with each device, in response to that message, compares the desired state of its parameters with their actual condition and returns an exception message only if there is a discrepancy between the two.

Each device can also, of course, be polled for the current state of its parameter values and, while in some cases such a poll may be of value, the relative demand on the serial link and the computational load on the centralized portion of the system are vastly greater.

CRT 174 will offer a two-dimensional plan, a three-dimensional view, or an abstract presentation of the physical system, as selected by the user. The contents of the Cue Record for the last cue will be presented on display 170. The current status of the system (or any selected cue) can also be presented on CRT 170 by reference to the "Stage" file. For example, a white device symbol outline can be used for all devices that change at least one parameter value in the current cue (symbol outline color attribute equals white for all devices with one or more PCRs with the current cue number). These symbols can also be filled with the current beam color if the fixture beam is on (symbol fill color attribute value equal to defined color attribute of current parameter value for all devices with non-zero intensity). Device symbol outlines and/or fills can, in other modes, reflect device groups and subgroups within a cue.

CRT 176 can reflect the absolute locations of the beams using a display such as illustrated in FIG. 16.

The user selects one or more devices for adjustment by numeric entry of the device address or by touching or designating the device symbol on the display as previously described. Conversely, in the display of an existing cue, all devices currently illuminating a symbolic location can be selected by touching or designating the alpha code or symbol for that location.

Upon selection of a device or group of devices the physical system display mode changes to highlight the selected devices by changing the source of the symbol outline color attribute value. By referring to mechanism values stored in the SDR records for the selected fixtures, the system composes on CRT 176, the appropriate Adjustment screen, for example, as illustrated in FIG. 13–15. Interaction with the Adjustment screen will open Parameter Change Records for the appropriate devices with a code for "Temporary" in the Cue Number field The creation of "Temporary" PCRs permits modification of previously-recorded adjustments without losing them, and the simultaneous display of the recorded value and a temporary value as described in connection with FIG. 13.

The user may modify the current cue with the new adjustments (which substitutes the current cue number for the "Temporary" code in the Cue Number field and deletes any existing PCRs with the same Cue, Device, and Parameter Identifier values); abandon the new adjustments and restore the previous state of the same cue (deleting the records with a "Temporary" code in the Cue Number field); or assign a new cue number to the modified state of the lighting system (by substituting the new Cue number for the "Temporary" code in the Cue Number field).

A new cue number may be entered at the flat panel display 170, by incrementing the record in the display to a new Cue Number using a touch field provided and/or using the keyboard 179K, and by "filling in" the remaining fields in the Cue Record. At entry of the alphanumeric memo, a portion of the flat panel display 170 can be redrawn to provide the necessary QWERTY keyboard.

During the performance, one or more of the displays can be used for Cue Sequence displays.

It will be seen that the disclosed control system permits the entry of new cues, and the examination and revision of existing ones in a uniquely efficient manner.

VIDEO IMAGE MEMORY

It will also be understood that the complexity of variable parameter cues renders their display difficult and ultimately it will prove most desirable to capture, by means of an imaging device, a picture of the stage under the conditions of illumination produced by that cue and to store it under a similar code number. Thereafter, previewing that cue will produce not only a numeric and/or graphic display of recorded data, but a visual display as well. Suitable hardware and software such as the A.T.&T. "Targa" system are available.

SIMULATION

It will also be seen that the disclosed system maintains all of the data required for known 3D imaging software to create a rendering of the effect of any cue for display on display 174 or 176 either as a still frame or, given sufficient processor power (for example, with the insertion of a dedicated graphics engine card), as an animation that permits the user to preview the effect of a cue without requiring the physical lighting system to produce it.

ALTERNATE INPUT DEVICES

It will be understood that while the disclosed operator interface preferably employs a subsystem locating the operator's finger over the graphic display, a subsystem sensing the location of a stylus or a light pen may also be employed.

It will be understood that subsystems (such as manufactured by Elographics or Zenith Data Systems) which sense not only X and Y finger or stylus location but pressure may be employed. This third output may be used to adjust height while entering absolute location (pressure increasing height above average stage level) or beam intensity, size, or saturation.

The resolution of available subsystems may be less than that of the controlled device where continuous adjustment is permitted. This requires strategies for providing the required range of adjustment.

One method is a scaling adjustment as disclosed in U.S. Pat. No. 4,460,943 where gain is adjusted either by operator selection or software switching in response to rate. Such a system, particularly in the incremental mode, allows a range of adjustment far in excess of the resolution of the display area provided.

Another method is to provide a "tapping" function (a high resolution incrementing function) with a set of fields adjacent to or surrounding the "pointing" field, such as the extended lines of the pointing symbol 335 in FIG. 15. By touching the pointing symbol 335, the operator may drag the beam to an approximate location. Finer adjustments may be made by tapping the extended lines of the symbol causing it to increment in the direction of the line by the minimum value Alternatively, large incrementing fields may be provided outside the adjustment area, fields which may be tapped or held to increment values.

MULTIPLE DISPLAYS

Finally, while a single display/interface may be employed by a control system, the use of a plurality of such displays vastly increases the speed and fluidity of operation by presenting all of the necessary information simultaneously and minimizing the number of mode changes required.

Therefore, at least two displays would be provided, preferably one at a relatively steep vertical angle in front of the operator for the Device Selection display and a second between the first and the operator and more nearly horizontal for fixture adjustments, cue records, virtual controls, and flowcharts.

Other variations within the spirit of the invention will be apparent and should not be understood as limited except by the claims.

What is claimed is:

1. A control system for a lighting system, said lighting system including: a plurality of light projectors, said projectors each generating a beam suitable for entertaining lighting and illuminating a common area, and each of a plurality of said plurality of projectors provided with means to vary a plurality of parameters of said beam, such as the azimuth, elevation, size, shape, color, or focus of said beam, said control system comprising:

(a) at least one first controller, said first controller adapted to the requirements of the control of said plurality of parameters of said beam, said first controller comprising at least:

(i) at least one memory capable of storing a plurality of first value sets for each of a plurality of said light projectors, each of said first value sets corresponding to desired adjustments of said plurality of parameters of said beam of at least one of said projectors in at least one desired lighting effect;

(ii) at least one means adapted for entering at least one of said first value sets corresponding to desired adjustments of said plurality of parameters for at least one of said projectors, said means adapted for entering operable from a location remote from said projector;

(iii) means, coupled with said means adapted for entering and with said memory, cooperating with said means for entering to store said first value set entered by said means for entering in said memory, and further for identifying at least one desired lighting effect with which said first value set should be associated;

(iv) means, coupled with said short-term memory, for producing at an output of said first controller, said first value sets corresponding to said desired adjustments of said beam associated with a specified lighting effect;

(b) means to conform for each of said plurality of light projectors, said means to conform located remotely from said first controller, having at least one input, and cooperating with said means to vary to produce said desired adjustments of said beam parameters when provided with a corresponding first value set via said input;

(c) serial data transmission means for coupling at least said output of said first controller with said input of each of a plurality of said means to conform via a common serial data transmission means such that first value sets for each of a plurality of said projectors may be transmitted from said output of said first controller to said input of said means to conform of the appropriate projectors;

the improvement wherein said control system further includes:

(d) means, coupled with said means to conform and with said serial data transmission means for maintaining at least one of said first value sets other than a first value set corresponding to the current adjustments of said beam parameters:

(e) means for determining at least the next lighting effect desired in a sequence;

(f) means for transferring, responsive to said means for determining and cooperating with said means for producing, means for coupling, and means for maintaining, for transferring said first value sets associated with at least said next lighting effect determined from said first controller to said means for maintaining via said serial data transmission means;

(g) means, operable from a location remote from said means to conform, for initiating the adjustment of said beam parameters by said means to conform so as to correspond to said first value sets transferred to said means for maintaining, said initiation separate from and subsequent to said transfer.

2. Apparatus according to claim 1, wherein said means to conform and to vary are further capable of varying the duration required to conform said beam parameters so as to correspond to said first values transferred to said means for maintaining, and wherein a value corresponding to said duration desired may be provided to said means to conform and means to vary.

3. Apparatus according to claim 2, wherein said value corresponding to said duration desired may be provided by said first controller.

4. Apparatus according to claim 2, wherein said value corresponding to said duration desired is transmitted via said serial data transmission means.

5. Apparatus according to claim 2, wherein a separate value corresponding to said duration desired may be provided to each of said light projectors.

6. Apparatus according to any one of claims 2, 3, 4 or 5, wherein said value corresponding to said desired duration is maintained by said means for maintaining.

7. Apparatus according to claim 1 or 2, wherein each of a plurality of said light projectors are provided with means to vary beam intensity, said means to vary beam intensity being responsive to additional values, each of said additional values corresponding to a desired adjustment of the intensity of said beam, and wherein said additional values are transmitted to said means to vary beam intensity via said serial data transmission means.

8. Apparatus according to claim 7, wherein said serial data transmission means employs data packets, and wherein said additional values for a plurality of said projectors are combined in a single such packet.

9. Apparatus according to claim 8, wherein said first value sets and said additional values for a given projector are transmitted in separate such data packets.

10. Apparatus according to claim 7, and further including a second controller, said second controller comprising an independent lighting memory controller adapted for intensity control and having at least one serial output for a plurality of values, each of said values corresponding to the desired intensity of at least one of said plurality of light projectors; wherein said control system further includes means for accepting said serial output of said second controller and for integrating said values corresponding to desired intensity as said additional values into said separate packets on said serial data transmission means.

11. Apparatus according to claim 10, wherein said values at said serial output of said second controller are formatted in data packets, each such data packet containing said values for a plurality of discrely-adjustable light projectors, and wherein said data packets produced by said second controllers are employed as said additional values in said separate packets substantially without a change in format.

12. A method for controlling a plurality of lighting fixtures lighting a common area, each such fixture producing a beam suitable for entertainment lighting and remotely-adjustable in a plurality of beam parameters such as the azimuth, elevation, size, shape, color, or focus of said beam, comprising the steps of:

providing a controller adapted for entering, storing, and recalling values corresponding to desired adjustments of a plurality of parameters of said beam of each of a plurality of said fixtures in each of a plurality of lighting effects;

entering and storing in said controller said values for each of a plurality of lighting effects;

providing, at each of said plurality of fixtures, a remotely-controllable means for conforming said parameters of said beam to said values stored for a selected lighting effect;

coupling said controller with said means for conforming for each of a plurality of said fixtures via a common serial data transmission means;

determining the next lighting effect desired in a sequence;

transferring said desired adjustment values for at least said next lighting effect from said controller to said means for conforming before said lighting effect is desired;

maintaining said desired adjustment values at said means for conforming;

causing said plurality of said means for conforming to conform said parameters of said beam to said previously-transferred values when said lighting effect is desired.

13. The method according to claim 12 and further including the steps of:

adapting said means to conform so as to be capable of varying to a selected duration, the duration of an adjustment of said parameters;

providing said selected duration to said means to conform.

14. In a lighting fixture, said fixture generating a beam suitable for entertainment lighting, provided with means to vary a plurality of parameters of said beam, such as the azimuth, elevation, size, shape, color, or focus of said beam, said means to vary operable from a location remote from said projector and responsive to first values corresponding to a desired adjustment of said remotely-variable parameters, said fixture provided with means to vary beam intensity, said means to vary beam intensity being responsive to additional values each corresponding to a desired adjustment of said beam intensity, said fixture further being provided with addressable means suitable for coupling to a serial data transmission means, said serial data transmission means distributing said first and said additional values for each of a plurality of differently-addressed fixtures in data packets, said means for coupling capable of supplying to said means to vary said first and said additional values for a selected said address, the improvement wherein said means for coupling is capable of acquiring said first and said additional values from separate data packets on said serial data transmission means, said additional values for a plurality of different addresses being contained in a common data packet.

15. The apparatus according to claim 14, wherein said means for coupling said fixture is capable of acquiring said first and said additional values for addresses different from each other.

16. A method for controlling a plurality of lighting fixtures lighting a common area, said fixtures producing a beam suitable for entertainment lighting, each of said fixtures remotely-adjustable in beam intensity, and each of a plurality of said plurality of said fixtures further remotely-adjustable in a plurality of beam parameters such as the azimuth, elevation, size, shape, color, or focus of said beam, comprising the steps of:

providing a first controller adapted for entering, storing, and recalling first values corresponding to desired adjustments of a plurality of parameters of said beam of each of said plurality of fixtures in each of a plurality of lighting effects;

entering and storing said values in said first controller for each of a plurality of said lighting effects;

providing, at each of said plurality of fixtures, a remotely-controllable means for conforming said parameters of said beam to said first values stored for a selected lighting effect;

providing a second controller capable of producing at at least one serial output, additional values corresponding to desired adjustments of beam intensity for each of a plurality of said fixtures;

providing, at each of said fixtures, a remotely-controllable means for conforming said beam intensity to said additional values;

coupling said first controller and said serial output of said second controller with said means for conforming said beam parameters and said beam intensity of each of a plurality of said fixtures via at least one common serial data transmission means so as to combine said first values produced by said first controller and said additional values produced by said second controller in a single serial data stream on said data transmission means, said additional values for a plurality of said fixtures transferred over said serial data transmission means in a common data packet.

17. In a lighting fixture, said fixture generating a beam suitable for entertainment lighting, provided with means to vary a plurality of parameters of said beam, such as the azimuth, elevation, size, shape, color, or focus of said beam, and with means to conform, said means to conform cooperating with said means to vary to produce a desired adjustment of said parameter when supplied with a corresponding first value, said fixture further being provided with means suitable for coupling to a serial data transmission means, said serial data transmission means distributing at least said first values for each of a plurality of separately-addressable fixtures from at least one source remote from said fixtures, the improvement wherein said means to conform and said means to vary are further capable of varying the duration required to conform said beam parameter so as to correspond to said first value distributed via said serial data transmission means to a desired duration greater than the minimum practical duration for such an adjustment, when supplied with a corresponding further value, wherein said further value is supplied via said serial data transmission means, and wherein, upon receipt of at least said first and said further value, said means to conform and means to vary may produce the desired adjustment over said desired duration greater than said minimum practical duration without requiring the transmission of values corresponding to adjustments of said beam parameter intermediate between the prior state and the desired state of said parameter.

18. Apparatus according to claim 17, wherein at least said first value corresponding to said desired adjustment is transmitted to said fixture via said serial data transmission means prior to the initiation of said desired adjustment.

19. Apparatus according to claim 18, wherein said initiation of said desired adjustment is caused by receipt of said fixture of a command separate from and subsequent to said corresponding first value.

20. Apparatus according to claim 19, wherein said command is transmitted via said serial data transmission means.

* * * * *

UNITED STATES PATENT AND TRADEMARK OFFICE

CERTIFICATE OF CORRECTION

PATENT NO. : 4,947,302

DATED : Aug. 7, 1990

INVENTOR(S) : MICHAEL CALLAHAN

It is certified that error appears in the above-identified patent and that said Letters Patent is hereby corrected as shown below:

Col. 1, line 10, after "represents" insert --a continuation of App. No. 250,316, entitled "Additive Color-Mixing Light Fixture Employing a Single Moveable Multi-Filter Array";--.

Col. 2, line 21, change "U.S." to --U.K.--.

Col. 3, line 5, change "'read world'" to --"real world"--.

Col. 6, line 18, insert --.-- at end of sentence.

Col. 6, line 35, insert --.-- at end of sentence.

Col. 6, line 46, after "eliminated" insert --.--.

Col. 6, line 51, insert --.-- at end of sentence.

Col. 6, line 53, change "U S" to --U.S.--.

Col. 9, line 16, after "actuator" insert --.--.

Col. 9, line 24, after "transitions" insert --.--.

Col. 9, line 32, after "query"insert --.--.

Col. 10, line 16, insert --.-- at end of sentence.

Col. 13, line 26, change "a" to --an--.

Col. 20, line 35, change "on" to --one--.

UNITED STATES PATENT AND TRADEMARK OFFICE

CERTIFICATE OF CORRECTION

PATENT NO. : 4,947,302

DATED : Aug. 7, 1990

INVENTOR(S) : MICHAEL CALLAHAN

It is certified that error appears in the above-identified patent and that said Letters Patent is hereby corrected as shown below:

Col. 24, line 12, after "Modify" insert --.--.

Col. 26, line 4, after "information" insert --.--.

Col. 27, line 18, after "status" insert --.--.

Col. 28, line 51, after "value" insert --.--.

Col. 29, line 38, change "a" to --as--.

Col. 32, line 45, after "field" insert --.--.

Col. 33, line 65, after "value" insert --.--.

Col. 36, line 7, change "discrely" to --discretely--.

Signed and Sealed this

Fifth Day of May, 1992

*Attest:*

DOUGLAS B. COMER

*Attesting Officer*

*Acting Commissioner of Patents and Trademarks*